US012259159B2

(12) United States Patent
Kim et al.

(10) Patent No.: US 12,259,159 B2
(45) Date of Patent: Mar. 25, 2025

(54) HYGIENE MANAGEMENT DEVICE FOR ENTRANCE HALL

(71) Applicant: LG ELECTRONICS INC., Seoul (KR)

(72) Inventors: Taihong Kim, Seoul (KR); Hyunbyung Cha, Seoul (KR); Hyunsun Yoo, Seoul (KR); Joohyeon Oh, Seoul (KR); Byoungjoonphilip Han, Seoul (KR); Sang Yoon Lee, Seoul (KR); HyunJu Kim, Seoul (KR); Chul Bae Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 615 days.

(21) Appl. No.: 17/550,675

(22) Filed: Dec. 14, 2021

(65) Prior Publication Data

US 2022/0186953 A1 Jun. 16, 2022

(30) Foreign Application Priority Data

Dec. 14, 2020 (KR) ..... 10-2020-0174512
Feb. 4, 2021 (KR) ..... 10-2021-0015907

(51) Int. Cl.
*F24F 8/22* (2021.01)
*F24F 9/00* (2006.01)
(Continued)

(52) U.S. Cl.
CPC ..... *F24F 8/22* (2021.01); *F24F 9/00* (2013.01); *F24F 11/79* (2018.01); *F24F 13/072* (2013.01);
(Continued)

(58) Field of Classification Search
None
See application file for complete search history.

(56) References Cited

U.S. PATENT DOCUMENTS 3,068,775 A 12/1962 Zehnder
10,532,119 B2 1/2020 Dombrowsky et al.
(Continued)

FOREIGN PATENT DOCUMENTS

CN 204503669 U * 7/2015 ..... B08B 5/02
CN 107320316 A 11/2017
(Continued)

OTHER PUBLICATIONS

English language machine translation for CN 108655109 A. Retrieved from translationportal.epo.org on Aug. 12, 2024. (Year: 2024).*
(Continued)

*Primary Examiner* — Jason M Greene
(74) *Attorney, Agent, or Firm* — Birch, Stewart, Kolasch & Birch, LLP

(57) ABSTRACT

A hygiene management device for an entrance hall is designed to emit far-UV light from upper and lower sides toward a person by reflecting the far-UV light emitted from the upper side to the person's lower body by a reflector located at the lower side, and reflecting the far-UV light emitted from the lower side to the person's upper body by a reflector located at the upper side. Accordingly, a sterilization effect on the person is improved.

20 Claims, 21 Drawing Sheets

(51) Int. Cl.
*F24F 11/79* (2018.01)
*F24F 13/072* (2006.01)
*F24F 120/12* (2018.01)

(52) U.S. Cl.
CPC ..... *F24F 2009/007* (2013.01); *F24F 2120/12* (2018.01)

(56) References Cited

U.S. PATENT DOCUMENTS

| | | | | | |
|---|---|---|---|---|---|
| 11,083,815 | B1 * | 8/2021 | Lee | ..... | A61L 9/20 |
| 2018/0369434 | A1 * | 12/2018 | Callahan | ..... | A61L 2/26 |
| 2019/0321503 | A1 * | 10/2019 | Warnell | ..... | A61L 2/10 |

FOREIGN PATENT DOCUMENTS

| | | | | | | |
|---|---|---|---|---|---|---|
| CN | 207285658 | U | * | 5/2018 | ..... | A61L 2/10 |
| CN | 108655109 | A | * | 10/2018 | ..... | A61L 9/20 |
| CN | 111514333 | A | | 8/2020 | | |
| CN | 111529725 | A | | 8/2020 | | |
| JP | 4109771 | B2 | | 7/2008 | | |
| KR | 10-2009-0040630 | A | | 4/2009 | | |
| KR | 10-1030583 | B1 | | 4/2011 | | |
| KR | 101030583 | | * | 4/2011 | ..... | A61L 2/10 |
| KR | 10-2019-0055303 | A | | 5/2019 | | |
| KR | 10-2019-0076579 | A | | 7/2019 | | |
| KR | 10-2020-0046715 | A | | 5/2020 | | |
| KR | 10-2151990 | B1 | | 9/2020 | | |
| KR | 10-2020-0117286 | | | 10/2020 | | |
| TW | 575149 | U | | 2/2004 | | |

OTHER PUBLICATIONS

English language machine translation for KR 10-1030583. Retrieved from translationportal.epo.org on Aug. 12, 2024. (Year: 2024 ).*
English language machine translation for CN 207285658 U. Retrieved from translationportal.epo.org on Aug. 13, 2024. (Year: 2024).*
English language machine translation for CN 204503669 U. Retrieved from translationportal.epo.org on Aug. 14, 2024. (Year: 2024).*

* cited by examiner

HYGIENE MANAGEMENT DEVICE FOR ENTRANCE HALL

CROSS REFERENCE TO RELATED APPLICATIONS

This application claims the priority benefit of Korean Patent Application No. 10-2020-0174512, filed on Dec. 14, 2020 in the Republic of Korea and Korean Patent Application No. 10-2021-0015907, filed on Feb. 4, 2021 in the Republic of Korea, which are hereby incorporated by reference in their entirety for all purposes as if fully set forth herein.

BACKGROUND OF THE INVENTION

1. Field of the Invention

The present disclosure relates to a device provided to manage the hygiene of a person who goes in and out of an entrance hall.

2. Description of the Background Art

Generally, an entrance hall is located between the outside and a specific indoor space to be connected to each other by an entrance hall. That is, a person is required to go through the entrance hall to enter the indoor space from the outside or to go out to the outside from the indoor space.

A vestibule is provided on an inner side of the entrance hall, and the preparation or maintenance of the vestibule is performed for a person going out of or in the vestibule.

Meanwhile, to prevent outdoor contaminants from being introduced into the indoor space, the contaminants of a person are preferably removed from outside of the vestibule or in the vestibule.

Accordingly, in the related art there is an air curtain to prevent contaminants from being introduced into the indoor space. However, the air curtain just blocks external air, but during the entering/exiting of a person, the external air may also be introduced into the vestibule.

To solve such a problem, there are various technologies disclosed in Korean Patent Application Publication No. 10-2009-0040630 (Patent Document 1), Korean Patent Application Publication No. 10-2020-0117286 (Patent Document 2), Korean Patent Application Publication No. 10-2020-0046715 (Patent Document 3), and Korean Patent Application Publication No. 10-2019-0055303 (Patent Document 4).

That is, in the technology disclosed in Patent Document 1, air is showered on a person to remove contaminants, such as dust, on the clothing of a person.

Furthermore, in the technology disclosed in Patent Document 2, in addition to the air shower, a photocatalytic coating is performed (i.e., applied) on a wall surface in a vestibule, and a photocatalytic lamp is installed on a ceiling, such that harmful substances, such as viruses remaining on the wall surface of the vestibule are destroyed.

Furthermore, in the technology disclosed in Patent Document 3, a lighting fixture and an air cleaning system are integrated with each other, such that contaminants are removed from a person in an entrance space, such as a vestibule.

Furthermore, in the technology disclosed in Patent Document 4, a shower booth having a predetermined shower space thereinside is separately installed, such that a person can remove contaminants in the shower booth.

Particularly, in each of the related technologies, in the circulation process of air discharged for air showering, after foreign matter contained in the associated air is removed, the air is redischarged.

However, the device of each of the related technologies described above only performs the function of filtering dust or foreign matter, but does not destroy harmful bacteria introduced along with a person.

Of course, in the case of the technology disclosed in Patent Document 2 described above, the function of sterilization and purification by using a photocatalyst is provided. However, in the technology disclosed in Patent Document 2 described above, the wall surface on which photocatalytic coating is applied is purified, so harmful bacteria remaining on a person's clothes and head is not destroyed.

Particularly, in the technology disclosed in Patent Document 2, light emitted by a light source using a photocatalyst is harmful to a human body, and thus is reflected toward a wall surface. Accordingly, the harmful light is not emitted toward a person, so it is virtually impossible to remove harmful bacteria present on the person.

Of course, it is possible to sterilize a person by providing a light source (for example, a far-UV light source) which emits light harmless to the human body and destroys only bacteria in the device of each Patent Document described above.

However, it is not possible to sterilize a person's entire body part with a conventional UV lamp. That is, only a part of the person facing the UV lamp is sterilized, and an overall sterilization effect is extremely low.

For example, when installing a UV lamp on the ceiling of a vestibule, a sterilization effect can be obtained up to a person's upper body but cannot be obtained up to the person's lower body.

Documents of Related Art (Patent Document 1) Korean Patent Application Publication No. 10-2009-0040630

(Patent Document 2) Korean Patent Application Publication No. 10-2020-0117286

(Patent Document 3) Korean Patent Application Publication No. 10-2020-0046715

(Patent Document 4) Korean Patent Application Publication No. 10-2019-0055303

SUMMARY OF THE INVENTION

Accordingly, the present disclosure has been made keeping in mind the above problems occurring in the related art.

That is, the present disclosure is intended to propose a hygiene management device in which during entering/exiting of a person, far-UV light is emitted toward the person to kill harmful bacteria present on the person's clothes. However, an alternate type of UV light or sterilizing light may be used.

In addition, the present disclosure is intended to propose a hygiene management device in which sufficient far-UV light is supplied to not only a person's upper body but also the person's lower body such that a sterilization effect on the person is improved.

Furthermore, the present disclosure is intended to propose a hygiene management device in which far-UV light is supplied evenly to the entire periphery of a person such that sterilization effect on the person is improved.

Additionally, the present disclosure is intended to propose a hygiene management device in which a light source for the emission of far-UV light is provided in a footrest of the hygiene management device and air is introduced into the footrest.

In order to achieve the above objectives, according to the hygiene management device for an entrance hall of the present disclosure, a UV emission part which emits far-UV light may be provided on each of a top plate and a footrest of the hygiene management device.

In addition, according to the hygiene management device for an entrance hall of the present disclosure, a first UV emission part located in the top plate may be configured to emit far-UV light toward a person's upper body.

Furthermore, according to the hygiene management device for an entrance hall of the present disclosure, a second UV emission part located in the footrest may be configured to emit far-UV light toward a person's lower body.

Additionally, according to the hygiene management device for an entrance hall of the present disclosure, the first UV emission part may be provided on the lower surface of the top plate.

In addition, according to the hygiene management device for an entrance hall of the present disclosure, a first reflector which reflects far-UV light emitted from the second UV emission part to a person may be provided on the lower surface of the top plate.

Furthermore, according to the hygiene management device for an entrance hall of the present disclosure, the first reflector may be configured along the perimeter of the first UV emission part.

Additionally, according to the hygiene management device for an entrance hall of the present disclosure, a first concave part may be formed on the lower surface of the top plate, and the first UV emission part may be provided in the first concave part.

In addition, according to the hygiene management device for an entrance hall of the present disclosure, the first reflector may be configured to be inclined or rounded.

Furthermore, according to the hygiene management device for an entrance hall of the present disclosure, the second UV emission part may be provided on the upper surface of the footrest.

Additionally, according to the hygiene management device for an entrance hall of the present disclosure, a second reflector which reflects far-UV light emitted from the second UV emission part to a person may be provided on the upper surface of the footrest.

In addition, according to the hygiene management device for an entrance hall of the present disclosure, the second reflector may be configured (i.e., positioned) along the perimeter of the second UV emission part.

Furthermore, according to the hygiene management device for an entrance hall of the present disclosure, a second concave part may be formed in the upper surface of the footrest, and the second UV emission part may be provided in the second concave part.

Additionally, according to the hygiene management device for an entrance hall of the present disclosure, the second reflector may be formed to be inclined or rounded.

In addition, according to the hygiene management device for an entrance hall of the present disclosure, a duct unit which guides an air flow to the top plate may be provided.

Furthermore, according to the hygiene management device for an entrance hall of the present disclosure, a fan assembly which blows air to the duct unit may be provided.

Additionally, according to the hygiene management device for an entrance hall of the present disclosure, the footrest may be configured such that air is introduced into the footrest through the upper surface of the footrest.

In addition, according to the hygiene management device for an entrance hall of the present disclosure, the fan assembly may be configured to receive air introduced into the footrest through an air management module.

Furthermore, according to the hygiene management device for an entrance hall of the present disclosure, at least one filter may be provided in the air management module.

Additionally, according to the hygiene management device for an entrance hall of the present disclosure, the air management module may be connected to a perimeter surface of the footrest.

In addition, according to the hygiene management device for an entrance hall of the present disclosure, an introduction flow path which guides air to the connection portion of the footrest with the air management module may be formed in the footrest.

Furthermore, according to the hygiene management device for an entrance hall of the present disclosure, a plurality of support bars may be provided on the upper surface of the footrest and the support bars may be spaced apart from each other, and the introduction flow path may be formed in a gap formed between each of the support bars.

Additionally, according to the hygiene management device for an entrance hall of the present disclosure, the second UV emission part may be located in at least one portion between each of the support bars.

In addition, according to the hygiene management device for an entrance hall of the present disclosure, a discharge hole through which air is discharged toward a person may be formed in the top plate.

Furthermore, according to the hygiene management device for an entrance hall of the present disclosure, the discharge hole may be configured such that air is discharged toward a person from the outer side of the first UV emission part.

Additionally, according to the hygiene management device for an entrance hall of the present disclosure, the first UV emission part may be provided at a center portion of the top plate.

In addition, according to the hygiene management device for an entrance hall of the present disclosure, a detector which detects the entering of a person may be provided on at least one of the top plate and the footrest.

Furthermore, according to the hygiene management device for an entrance hall of the present disclosure, each of the UV emission parts (i.e., the first UV emission part and the second UV emission part) may operate when a person is detected by the detector.

Additionally, according to the hygiene management device for an entrance hall of the present disclosure, the top plate may be located at the upper side of an entrance space, and the footrest may be located on a bottom of the entrance space, wherein the first UV emission part which emits far-UV light toward a person's upper body and the first reflector may be provided in the top plate, and the second UV emission part, which emits far-UV light toward a person's lower body and the second reflector may be provided in the footrest.

The hygiene management device for an entrance hall of the present disclosure described above may have at least one of the following effects.

In the hygiene management device for an entrance hall of the present disclosure, the UV emission part may be provided in the entrance space and thus during the entering/ exiting of a person, far-UV light may be emitted toward the person. Accordingly, harmful bacteria present on the person's clothes may be killed.

In addition, in the hygiene management device for an entrance hall of the present disclosure, the UV emission part may be provided in each of the top plate located at the upper side of the entrance space and the footrest located on the bottom of the entrance space (i.e., bottom side). Accordingly, sufficient far-UV light may be emitted to the person's upper and lower bodies.

Furthermore, the hygiene management device for an entrance hall of the present disclosure may be configured such that far-UV light emitted by the second UV emission part is reflected to a person by the first reflector. Accordingly, far-UV light may be emitted evenly to the entire portion of the person's upper body.

Additionally, in the hygiene management device for an entrance hall of the present disclosure, the first concave part may be formed on the lower surface of the top plate, and the first UV emission part maybe provided in the first concave part. Accordingly, far-UV light may be maximally concentrated toward a person.

In addition, in the hygiene management device for an entrance hall of the present disclosure, the first reflector may be formed along a circumference of the first concave part. Accordingly, far-UV light may be emitted even to a portion to which the far-UV light emitted by the first UV emission part is not emitted (i.e., the far-UV light may be reflected to cover portions of the person not directly receiving the far-UV light emitted by the first UV emission part).

Furthermore, the hygiene management device for an entrance hall of the present disclosure may be configured such that far-UV light emitted by the first UV emission part is reflected to a person by the second reflector. Accordingly, far-UV light may be emitted evenly to the entire portion of the person's lower body.

Additionally, in the hygiene management device for an entrance hall of the present disclosure, the second concave part may be formed in the bottom surface of the footrest, and the second UV emission part may be provided in the second concave part. Accordingly, far-UV light may be concentrated as much as possible toward a person.

In addition, in the hygiene management device for an entrance hall of the present disclosure, the second reflector may be configured along the circumference of the second concave part. Accordingly, far-UV light may be supplied even to a portion to which far-UV light supplied from the second UV emission part is not supplied.

Furthermore, in the hygiene management device for an entrance hall of the present disclosure, the detector may be provided on at least one of the top plate and the footrest. Accordingly, the UV emission part may operate only when a person is detected.

Additionally, in the hygiene management device for an entrance hall of the present disclosure, each of the support bars may be provided on the footrest, and the second UV emission part may be provided between each of the support bars. Accordingly, although the second UV emission part is located directly below a person, damage to the second UV emission part may be prevented.

In addition, in the hygiene management device for an entrance hall of the present disclosure, the fan assembly may be configured to be connected (e.g., fluidly connected) to the footrest. Accordingly, foreign matter present on the footrest may be removed from the footrest.

Furthermore, in the hygiene management device for an entrance hall of the present disclosure, at least one filter may be provided in a part through which air flows from the footrest to the fan assembly. Accordingly, foreign matter contained in air in the entrance space and foreign matter accumulated on the footrest may be removed by the filter.

Additionally, in the hygiene management device for an entrance hall of the present disclosure, the duct unit may be provided. Accordingly, air may be discharged toward a person, and thus dust, foreign matter, or harmful substances accumulated on the person's head or clothes may be removed from the person.

In addition, the hygiene management device for an entrance hall of the present disclosure may be configured such that the air of the entrance space is repeatedly circulated (i.e., continuously circulated) through the air management module. Accordingly, the air of the entrance space may be constantly maintained to be clean (e.g., purified and free from dust and other contaminants).

Further scope of applicability of the invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
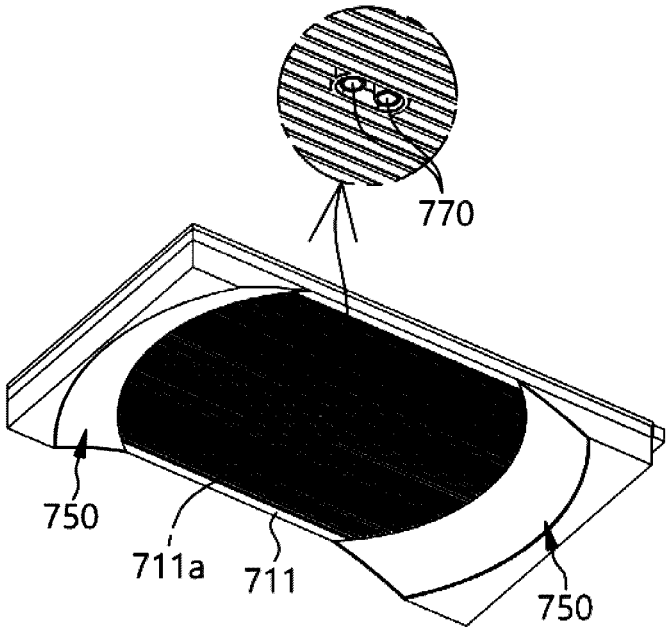
FIG. 1 is a bottom perspective view illustrating a hygiene management device for an entrance hall according to an embodiment of the present invention.
Figure 1:
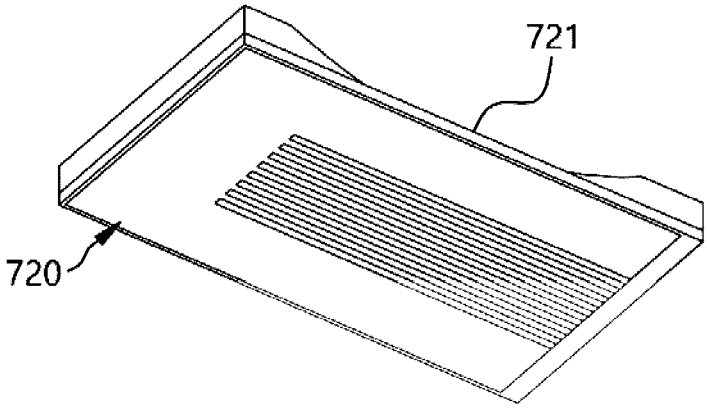

The present invention will now be described with reference to the accompanying drawings, wherein the same reference numerals have been used to identify the same or similar elements throughout the several views.

Hereinafter, the exemplary embodiment of the hygiene management device for an entrance hall of the present disclosure will be described with reference to FIGS. 1 to 21.

Prior to description, the hygiene management device for an entrance hall according to the embodiment of the present disclosure may be installed in an entrance space through which a person goes in and out of an indoor space.

For example, when the hygiene management device for an entrance hall is installed in a residential space, the hygiene management device for an entrance hall may be installed in a vestibule. That is, the vestibule may be the entrance space.

When the hygiene management device for an entrance hall is installed in an office space, the hygiene management device for an entrance hall may be installed in space provided in the entrance hall of the office space.

Figure 2:
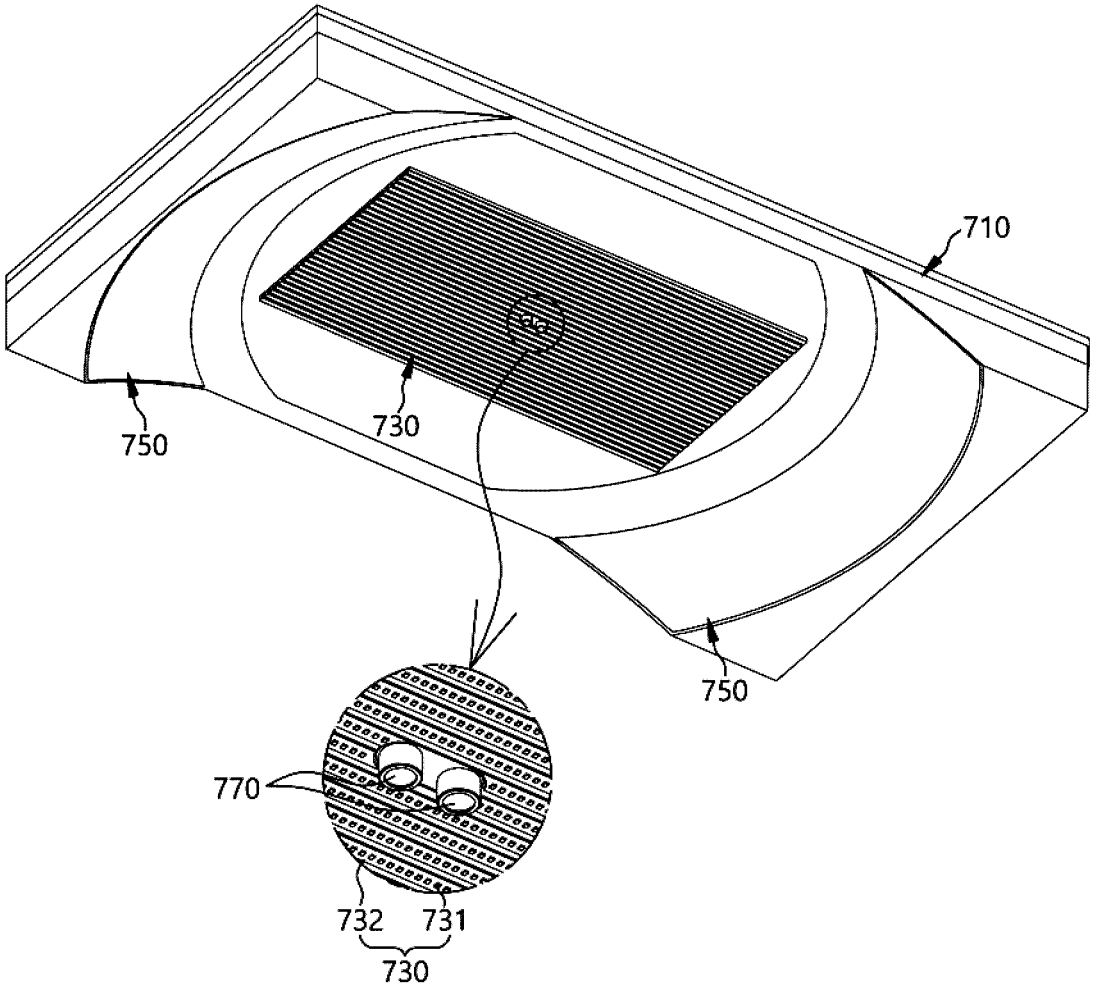
FIG. 2 is a bottom perspective view illustrating the top plate of the hygiene management device for an entrance hall according to an embodiment of the present invention.
Figure 3:
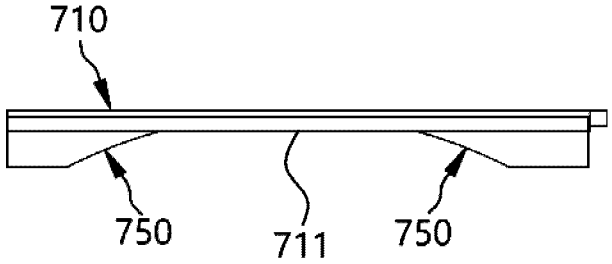
FIG. 3 is a side view illustrating the hygiene management device for an entrance hall according to an embodiment of the present invention.
Figure 3:
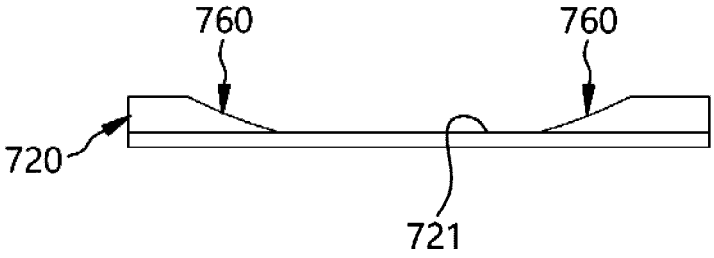
Figure 4:
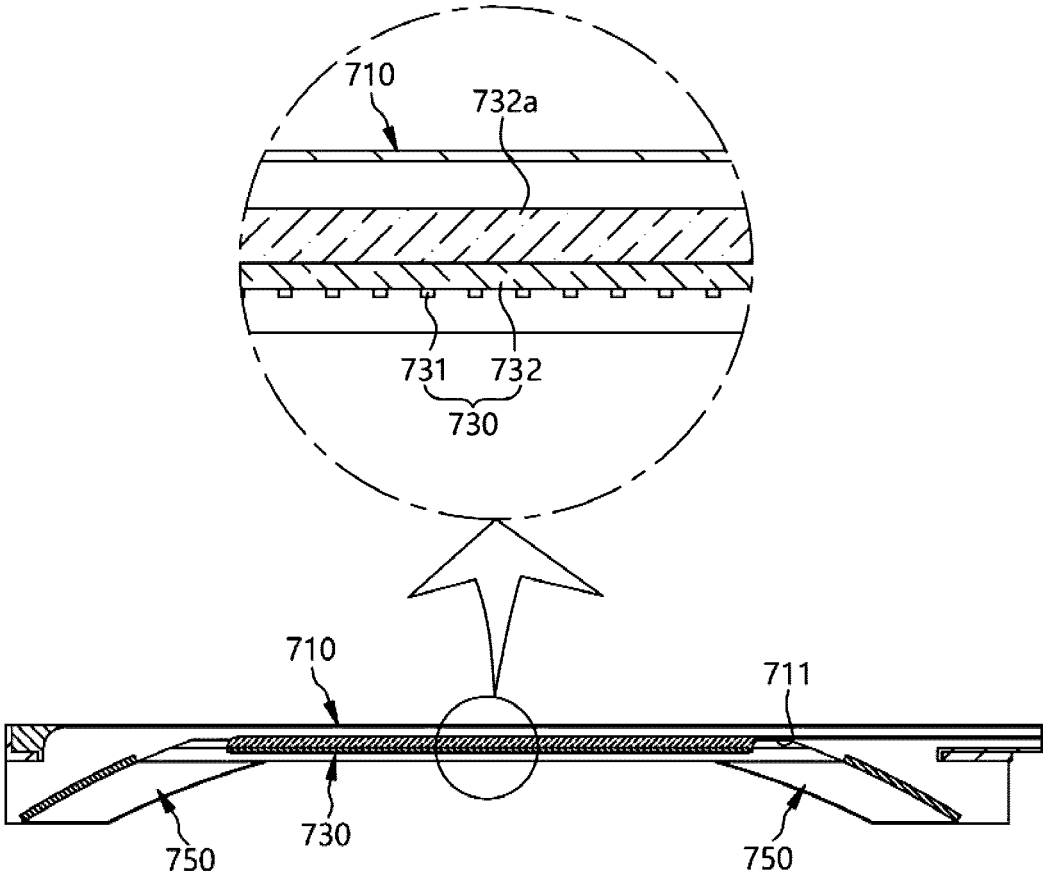
FIG. 4 is a sectional view illustrating a state in which the inner structure of the top plate of the hygiene management device for an entrance hall according to an embodiment of the present invention as seen from the side of the top plate.
Figure 5:
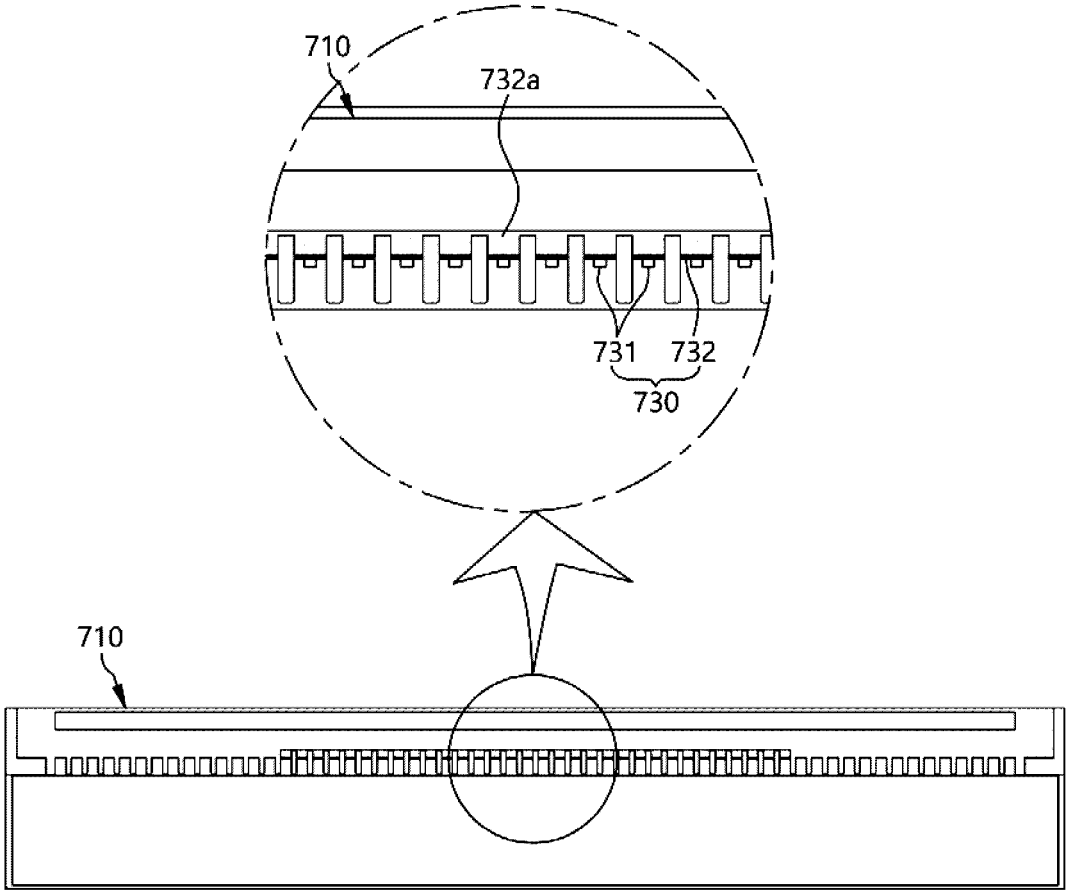
FIG. 5 is a sectional view illustrating a state in which the inner structure of the top plate of the hygiene management device for an entrance hall according to an embodiment of the present invention as seen from the front of the top plate.

FIGS. 1 and 2 are bottom perspective views illustrating, respectively, the overall structure of a top plate and a footrest and the detailed structure of the top plate, and FIG. 3 is a side view illustrating the installed states of the top plate and the footrest. Additionally, FIGS. 4 and 5 are sectional views of the top plate.

Figure 6:
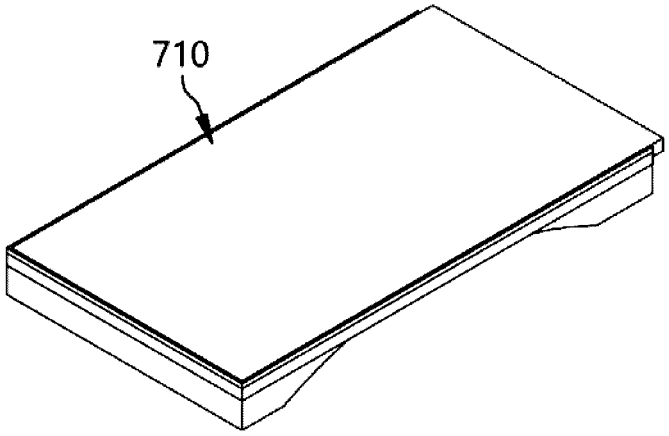
FIG. 6 is a perspective view illustrating the upper portion of the hygiene management device for an entrance hall according to an embodiment of the present invention.
Figure 6:
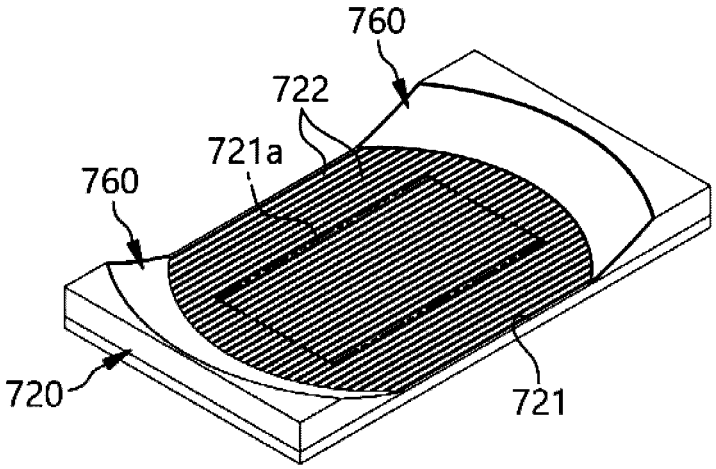
Figure 7:
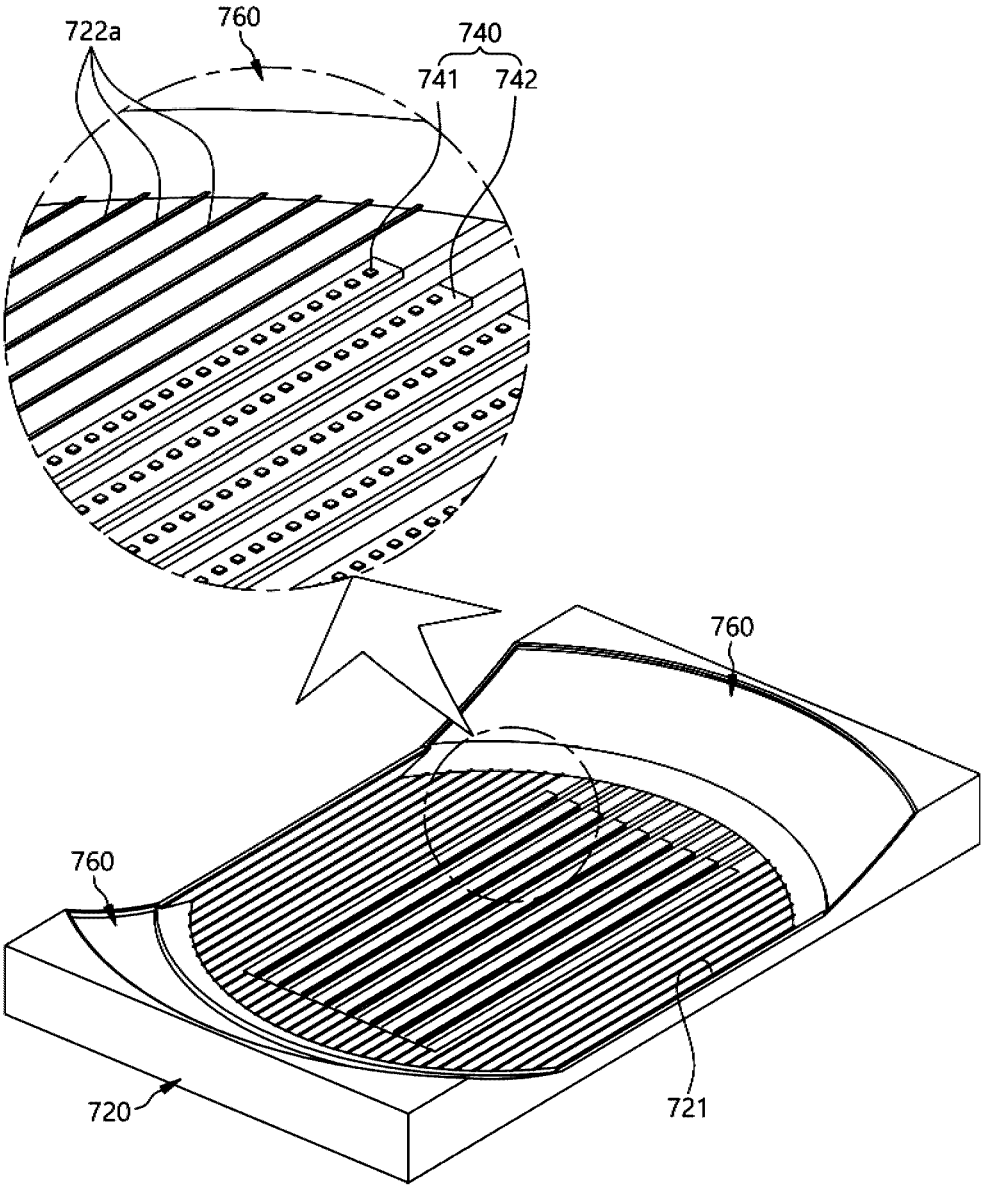
FIG. 7 is a top perspective view of the footrest of the hygiene management device for an entrance hall an embodiment of the present invention from which a lower support bar is omitted.
Figure 8:
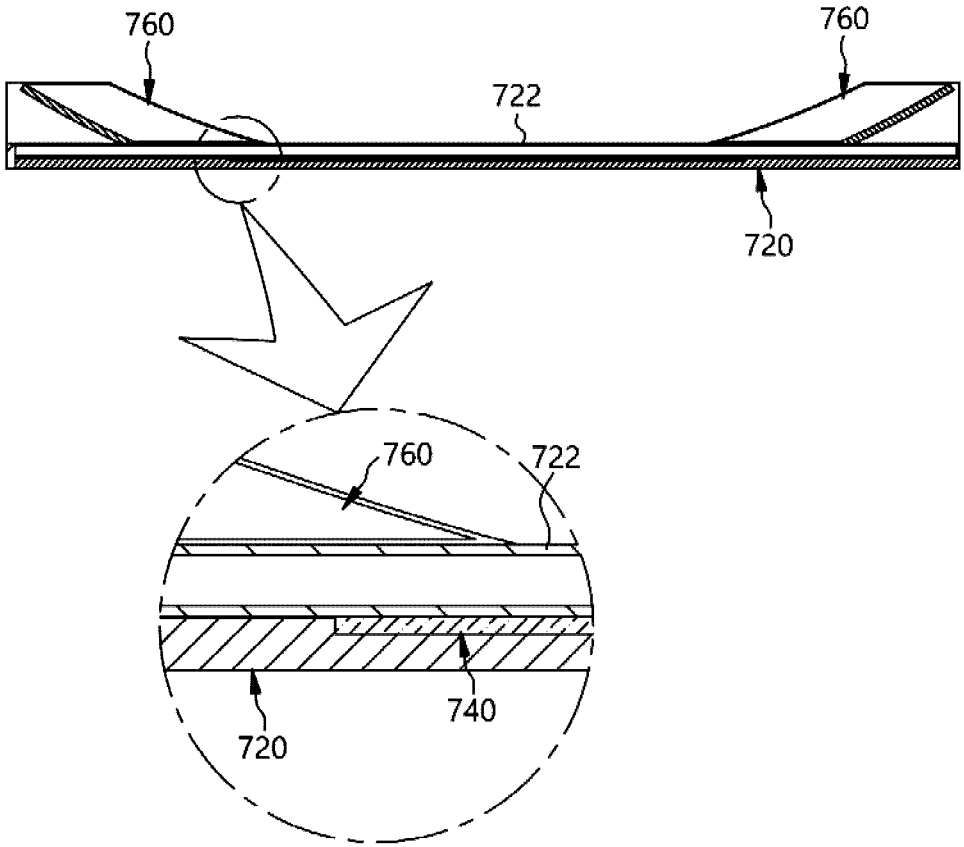
FIG. 8 is a sectional view of the internal structure of the footrest of the hygiene management device for an entrance hall according to an embodiment of the present invention when viewed from the side of the footrest.
Figure 9:
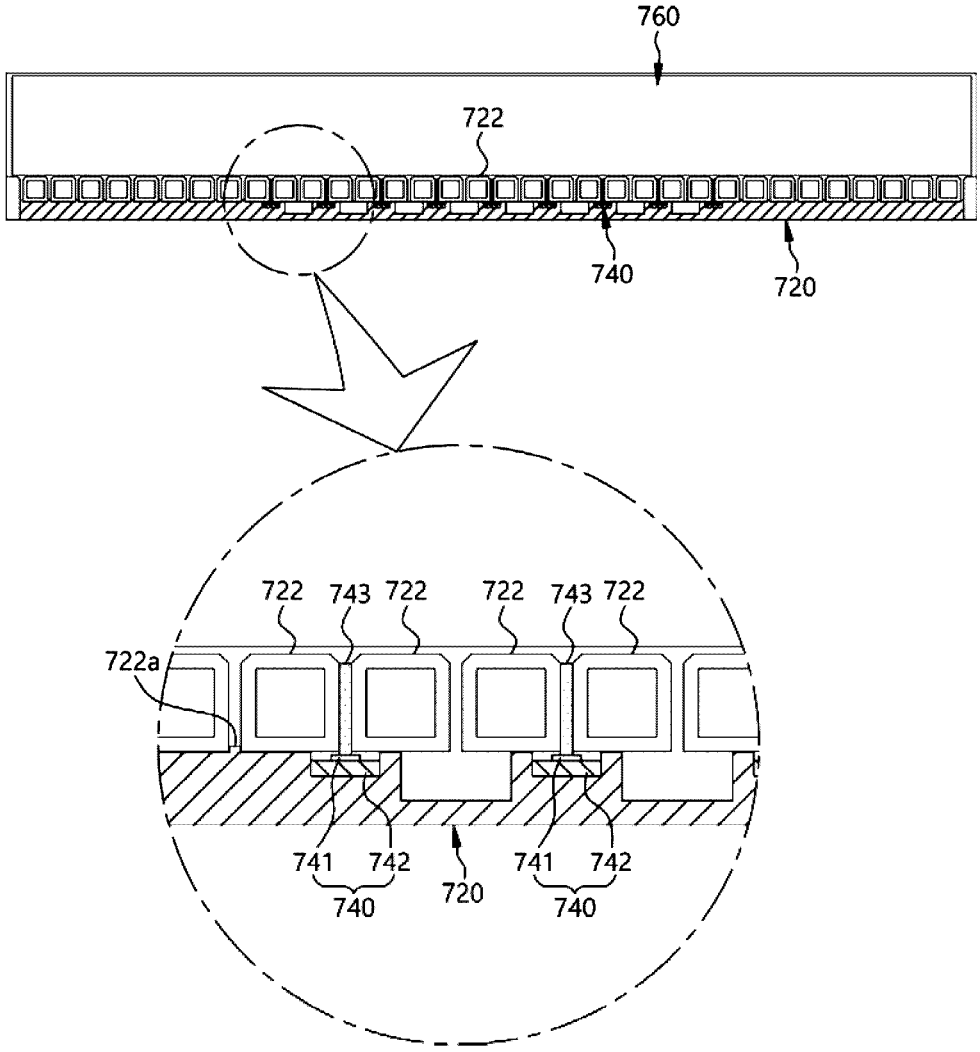
FIG. 9 is a sectional view of the internal structure of the footrest of the hygiene management device for an entrance hall according to an embodiment of the present invention when viewed in front of the footrest.

Furthermore, FIGS. 6 and 7 are top perspective views illustrating respectively the overall structure of the top plate and the footrest and the detailed structure of the footrest, and FIGS. 8 and 9 are sectional views of the footrest.

As illustrated in these drawings, the hygiene management device for an entrance hall according to the embodiment of the present disclosure may include UV emission parts 730 and 740 (e.g., a first UV emission part 730 and a second UV emission part 740), and particularly, far-UV light emitted by the UV emission parts 730 and 740 may be emitted to the person's upper and lower bodies.

Hereinafter, each component of the hygiene management device for an entrance hall having such characteristics according to the embodiment of the present disclosure will be described more in detail.

First, the hygiene management device for an entrance hall according to the embodiment of the present disclosure may include the top plate 710.

The top plate 710 may be located at the upper side of the entrance space. In this case, the top plate 710 may be embedded in the ceiling of the entrance space, or may be provided separately from the ceiling of the entrance space and may be located at the lower portion of the ceiling (e.g., below the ceiling).

As illustrated in FIGS. 1 to 5, the top plate 710 may be configured to have a rectangular plate shape or alternatively may have any shape. Of course, according to the shape of the entrance space, the top plate 710 may be formed in various shapes such as circular, oval, track-like, and polygonal shapes, etc. or may be configured as a block body having a predetermined thickness.

In addition, a first concave part 711 may be formed in the top plate 710. The first concave part 711 may be formed concavely on the surface of the top plate 710.

Specifically, the first concave part 711 may be formed in the center portion of the lower surface of the top plate 710. The lower surface facing a top surface of a footrest 720, which is described below.

Such a first concave part 711 may be provided as a part for the installation of a first UV emission part 730 to be described later. That is, when the first UV emission part 730 is provided in a part configured as a flat surface, it is difficult to emit far-UV light intensively to a position directly below the first UV emission part 730. Because of this, the emission amount of far-UV light toward a person located at the position directly below the first UV emission part 730 may be inevitably reduced.

In consideration of this, the first concave part 711 may be formed in the top plate 710, and the first UV emission part 730 may be provided in a predetermined area 711*a* (e.g., a first emission area) of the first concave part 711 such that far-UV light emitted by the first UV emission part 730 is maximally concentrated on a specific position (e.g., a person). The first concave part 711 may be formed in various shapes, such as circular, elliptical, track-like, and polygonal shapes, etc.

In addition, the circumferential surface of the first concave part 711 may be configured to be enlarged downward. That is, the circumferential surface of the first concave part 711 may be configured to be inclined or rounded. A first reflector 750 to be described later may be installed on such a circumferential surface of the first concave part 711. The first reflector 750 may be provided in plurality to include a first-first reflector 750 adjacent to a first side of the first concave part 711 and a second-first reflector 750 adjacent to a second side of the first concave part 711 opposite to the first side of the first concave part 711.

Figure 10:
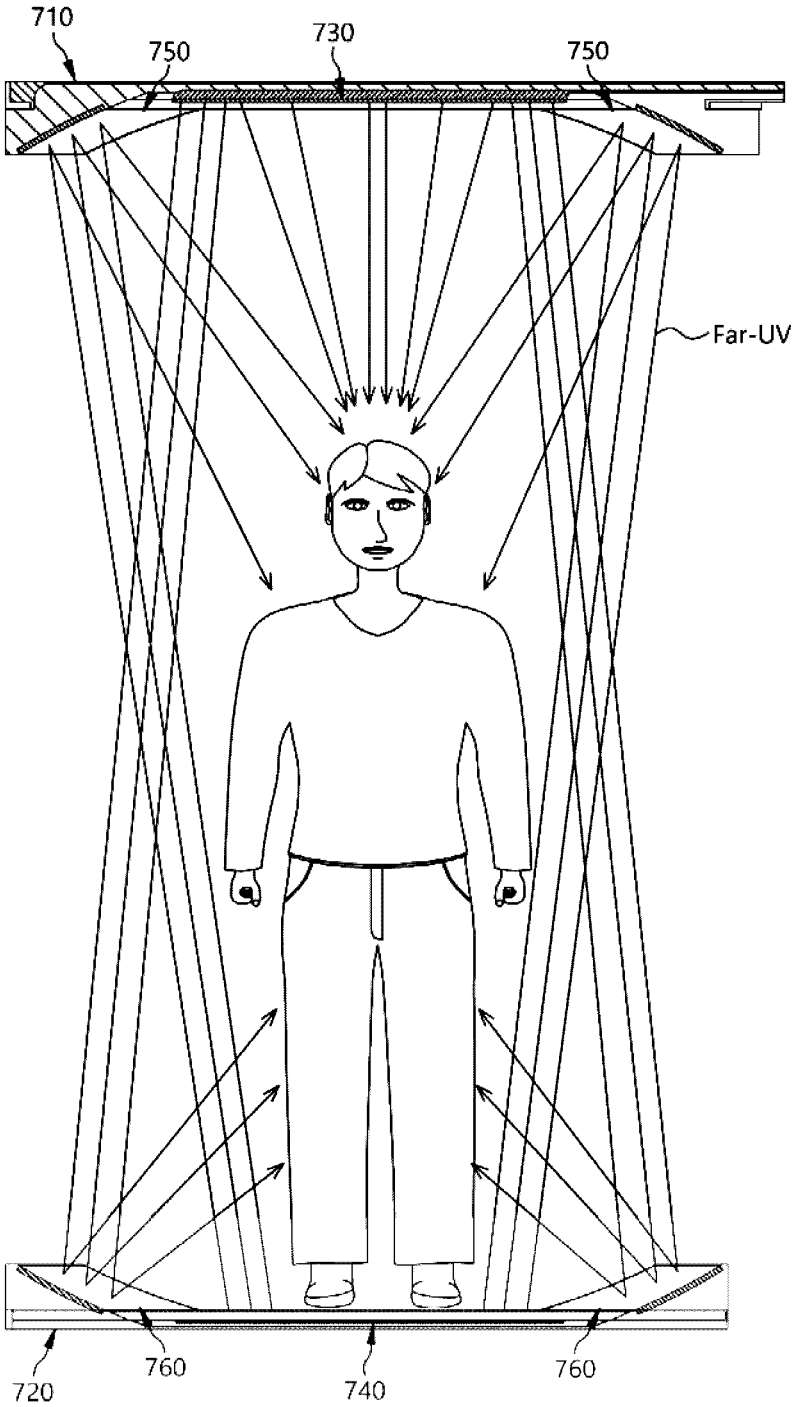
FIG. 10 is a side view of a state in which far-UV light is emitted to a person by the hygiene management device for an entrance hall according to an embodiment of the present invention.

That is, when it is considered that UV light is emitted only rectilinearly, as illustrated in FIG. 10, far-UV light emitted from a first UV emission part 730 may be concentrated on the top of a person's head or the person's shoulders, so much shade may be generated on the periphery thereof. That is, if the UV light is only emitted straight down, then the UV light will not reach the entirety of the body of the person.

In consideration of this, the circumferential surface of the first concave part 711 may be configured to be inclined or rounded, and the first reflector 750 may be installed on the associated portion. Accordingly, far-UV light emitted by a second UV emission part 740, which is disposed on the footrest 720, may be reflected by the first reflector 750 to be emitted to a person's upper body.

Next, the hygiene management device for an entrance hall according to the embodiment of the present disclosure may include the footrest 720, which forms a bottom surface of the hygiene management device.

The footrest 720 may be a part on which a person can stand. Such a footrest 720 may be configured to have such an area that at least one person can be located on the footrest 720, however, the footrest 720 may be designed to accommodate any number of people.

FIGS. 6 to 9 are views illustrating the embodiment of the footrest 720.

As illustrated in these drawings, the footrest 720 according to the embodiment of the present disclosure may be formed in a rectangular plate shape and FIG. 6 shows a perspective view of the top plate 710. Of course, according to the shape of the entrance space, the footrest 720 may be formed in various shapes such as circular, elliptical, track-like, and polygonal shapes, etc. Additionally, the footrest 720 may be configured as a block having a predetermined thickness or as an empty box.

A second concave part 721 may be formed in the upper surface of the footrest 720. Specifically, the second concave part 721 may be formed in the center portion of the upper surface of the footrest 720.

Such a second concave part 721 may be provided as a part for installing the second UV emission part 740, which is described later. That is, the second UV emission part 740 may be provided in a predetermined area 721*a* (e.g., a second emission area) of the second concave part 721 recessed from the surface of the footrest 720. Accordingly, far-UV light emitted by the second UV emission part 740 may be maximally concentrated on a specific position (e.g., a person) without being emitted in the surrounding directions of the person.

The second concave part 721 may be formed in various shapes such as circular, oval, track-like, and polygonal shapes, etc. The second concave part 721 may be configured to have the same size and shape as the first concave part 711 of the top plate 710. Of course, the second concave part 721 may be configured to be larger or smaller than the first concave part 711.

Particularly, the second concave part 721 may be configured to have such an area that a person can stand thereon. That is, when the person stands on the second concave part 721, far-UV light may be emitted toward the person.

Additionally, the circumferential surface of the second concave part 721 may be configured to be inclined or rounded so as to be enlarged upward. A second reflector 760 may be installed on the inclined or rounded circumferential surface of such a second concave part 721 such that the second reflector 760 is inclined or rounded. The second reflector 760 may be provided plurality to include a first second reflector 760 and a second-second reflector 760. Further, the first second reflector 760 may be disposed at a first side of the second concave part 721 and the second-second reflector 760 may be disposed at a second side of the second concave part 721 opposite to the first side of the second concave part 721. Accordingly, far-UV light emitted by the first UV emission part 730 may be reflected by the second reflector 760 to be emitted to a person's lower body.

In addition, the footrest 720 may include lower support bars 722 (i.e., support bars). Such lower support bars 722 may provide a position at which the second UV emission part 740, which is described later, is installed.

That is, each of the lower support bars 722 may be provided to prevent a person from damaging the second UV emission part 740 by stepping on the second UV emission part 740. That is, the lower support bars 722 may be disposed above the second UV emission part 740.

Such a lower support bar 722 may include multiple lower support bars (e.g., a plurality of lower support bars 722) and may be provided on the upper surface of the footrest 720 (e.g., may define the upper surface of the footrest 720).

Particularly, each of the lower support bars 722 may be disposed to be spaced apart from each other by a guide rib 722*a*. That is, the second UV emission part 740 to be described later may be located between each of the lower support bars 722 (i.e., and below each of the lower support bars 722). Accordingly, a person may only step on each of the lower support bars 722 but not on the second UV emission part 740, thereby preventing breakage or damage to the associated second UV emission part 740.

The lower support bars 722 described above may be provided on the upper surface of the second concave part 721 in the upper surface of the footrest 720. That is, the lower support bars 722 may be located at a position through which a person enters or exit an indoor space. Of course, the lower support bars 722 may be installed on the entire portion of the upper surface of the footrest 720, or less than an entire portion of the upper surface of the footrest 720 due to the second reflector(s) 760.

In addition, the lower support bar 722 may be configured as a rectangular tube having a rectangular cross-section. That is, the lower support bar 722 may have a hollow shape, thereby ensuring durability against external forces and reducing the entire weight of the footrest 720.

Next, the hygiene management device for an entrance hall according to the embodiment of the present disclosure may include the UV emission parts 730 and 740.

The UV emission parts 730 and 740 may be configured to emit far-UV (e.g., far ultraviolet) light toward a person. However, the first and second UV emission parts 730 and 740 may emit near ultraviolet (N-UV), middle ultraviolet (M-UV), hydrogen lyman-alpha (H Lyman-α), extreme ultraviolet (E-UV), ultraviolet A, ultraviolet B, ultraviolet C, or any type of UV light.

The UV emission parts 730 and 740 may include the first UV emission part 730 which emits far-UV light toward a person's upper body.

The first UV emission part 730 may be provided in the top plate 710. The first UV emission part 730 may be installed in the entire portion of the top plate 710 or only in a portion of the top plate 710.

Preferably, the first UV emission part 730 may be installed in the first concave part 711 of the top plate 710. That is, the first UV emission part 730 may be located only in a portion below which a person is to be located (e.g., when the person is positioned within the hygiene management device according to the present invention).

As illustrated in FIGS. 4 and 5, the first UV emission part 730 may include a UV light source 731 which emits far-UV light. The UV light source 731 may be configured as multiple UV-LEDs mounted to a substrate 732.

That is, the UV light source 731 is configured as the UV-LEDs to as to emit as much far-UV light as possible in a desired direction. In this case, the desired direction may be directed to a position directly below the UV light source 731 in which a person is located. Of course, the UV light source 731 may be configured as a fluorescent lamp structure.

The substrate 732 may include a plurality of substrates or may be provided as a single substrate. In addition, when the substrate 732 includes a plurality of substrates, the substrates may be configured to be mounted to a mounting plate 732*a* such that each of the substrates can be assembled with and disassembled from the mounting plate 732*a*.

In addition, the UV emission parts 730 and 740 may include the second UV emission part 740 which emits far-UV light toward a person's lower body.

The second UV emission part 740 may be provided in the footrest 720. The second UV emission part 740 may be installed in the entire portion of the footrest 720 or only in a portion thereof.

Preferably, the second UV emission part 740 may be installed in the second concave part 721 of the footrest 720. That is, the second UV emission part 740 may be located only in a portion on which a person is located.

As illustrated in FIGS. 7 and 9, such a second UV emission part 740 may include a UV light source 741 which emits far-UV light. The UV light source 741 may be configured as multiple UV-LEDs mounted to a substrate 742.

Particularly, the second UV emission part 740 described above may be located in at least one portion between the lower support bars 722 provided in the second concave part 721. Specifically, the second UV emission part 740 may include a plurality of second UV emission parts 740 such that each of the second UV emission parts 740 defines a predetermined portion and may be located between the plurality of lower support bars 722. That is, the second UV emission part 740 may be configured to be located between each of the lower support bars 722 such that the second UV emission part 740 emits far-UV light toward a person's lower body.

Accordingly, the second UV emission part 740 may not be exposed to the outside and may be protected by each of the lower support bar 722, thereby preventing damage to the second UV emission part 740, such as breakage, which may be caused by a person stepping on or hitting the second UV emission part 740.

Predetermined portions defined by the second UV emission parts 740 may have an area larger than an area in which a person is located. Of course, the second UV emission part 740 may be provided in the entire portion of the second concave part 721.

In addition, the second UV emission part 740 may include a light guide plate 743. The light guide plate 743 may protect the UV light source 741 from an external environment and may allow far-UV light emitted from the associated UV light source 741 to be sufficiently emitted through a gap between each of the lower support bars 722 to a person.

Such a light guide plate 743 may be located between each of the lower support bars 722 between which the UV light source 741 is installed. Specifically, the light guide plate 743 may be configured to have about the same thickness as a gap between each of the lower support bars 722 or may have exactly the same thickness as the gap between each of the lower support bars 722.

Next, the hygiene management device for an entrance hall according to the embodiment of the present disclosure may include reflectors 750 and 760 (e.g., first and second reflectors 750, 760).

The reflectors 750 and 760 may function to reflect far-UV light emitted from the UV emission parts 740 and 730, respectively, in specific directions.

The reflectors 750 and 760 may include the first reflector 750 located at the top plate 710. The first reflector 750 may be configured to reflect far-UV light emitted upward from the second UV emission part 740 toward a person.

That is, when a person is located in the installed area of the second UV emission part 740 (e.g., the person is located on the footrest 720), far-UV light of the second UV emission part 740 may be emitted to the person. However, the far-UV light of a second UV emission part 740 installed (e.g., located) at a position outside a position at which the person is located may not be emitted to the person, but may be emitted directly toward the top plate 710. Accordingly, the far-UV light emitted upward from the second UV emission part 740 of the position at which the person is not located may be reflected by the first reflector 750 to be emitted to the person.

Particularly, as illustrated in FIG. 10, the first reflector 750 may be configured such that the far-UV light is reflected to the periphery of the person's upper body.

That is, far-UV light emitted from the first UV emission part 730 may be concentrated on a person's head or shoulder, and far-UV light emitted from the second UV emission part 740 may be concentrated on a person's legs. Accordingly, much shade may be generated on the periphery of the person's upper body (head, shoulders, chest, or back).

In consideration of this, far-UV light may be emitted to the periphery of the person's upper body by the first reflector 750.

Such a first reflector 750 may be installed on the inclined (or rounded) circumferential surface of the first concave part 711. That is, the first reflector 750 may be installed to be inclined (or rounded) by the inclined (or rounded) circumferential surface of the first concave part 711 such that far-UV light is reflected to the periphery of the person's upper body from the upper side of the person.

The circumferential surface of the first concave part 711 may be configured vertically (i.e., facing a vertical direction) and the lower surface (e.g., a surface directed toward a person) of the first reflector 750 may be configured to be inclined or rounded.

The first reflector 750 may be formed in the first concave part 711 at which the first UV emission part 730 is located.

The first reflector 750 may be provided on the perimeter surface of the top plate 710. That is, the first reflector 750 may protrude downward from the perimeter surface of the top plate 710 to be inclined or rounded. In this case, the first concave part 711 may not be formed.

In addition, the reflectors 750 and 760 may include the second reflector 760 located on the footrest 720. The second reflector 760 may be configured such that the second reflector 760 reflects far-UV light emitted downward from the first UV emission part 730 toward a person.

That is, in a portion in which each of the first UV emission parts 730 is installed, the first UV emission part 730 at a position below which a person is located may emit far-UV light toward the person. However, a first UV emission part 730 at a position below which the person is not located may not emit far-UV light toward the person but emit the far-UV light directly toward the footrest 720. Accordingly, the far-UV light emitted downward from the first UV emission part 730 at the position below which the person is not located may be reflected by the second reflector 760 to be emitted to the person.

Particularly, as illustrated in FIG. 10, the second reflector 760 may be configured such that the far-UV light is reflected to the periphery of the person's lower body.

That is, the far-UV light emitted from the first UV emission part 730 may be concentrated on a person's head or shoulders, and far-UV light emitted from the second UV emission part 740 may be concentrated on a person's legs. Accordingly, much shade may be generated on the periphery (buttocks, waist, and thighs) of the person's lower body.

In consideration of this, far-UV light may be emitted to the periphery of a person's lower body by the second reflector 760.

Such a second reflector 760 may be installed on the inclined (or rounded) circumferential surface of the second concave part 721. That is, the second reflector 760 may be installed to be inclined (or rounded) by the inclined (or rounded) circumferential surface of the second concave part 721 such that far-UV light is reflected to the periphery of the person's lower body from the lower side of the person.

The circumferential surface of the second concave part 721 may be formed vertically and only the upper surface (a surface directed toward a person) of the second reflector 760 may be configured to be inclined or rounded.

The second reflector 760 may be formed in the second concave part 721 at which the second UV emission part 740 is located.

The second reflector 760 may be provided on the perimeter surface of the footrest 720, surrounding the second concave part 721. That is, the second reflector 760 may protrude upward from the perimeter surface of the footrest 720 to be inclined or rounded. Alternative, the second concave part 721 may not be formed.

Meanwhile, a detector 770 which detects the entering of a person may be provided on at least one of the top plate 710 and the footrest 720, as illustrated in FIG. 2. Additionally, each of the UV emission parts 730 and 740 may operate on the basis of a signal detected by the detector 770.

That is, each of the UV emission parts 730 and 740 may operate when a person is detected by the detector 770 such that unnecessary power consumption is prevented.

The detector 770 may be configured as various types of sensors that can detect whether a person enters, such as a human body detection sensor, a proximity sensor, and an infrared sensor.

In addition, the detector 770 may be positioned on the lower surface of the top plate 710 facing the footrest 720 so as to improve sensing accuracy.

Meanwhile, the top plate 710 and the footrest 720 may be installed separately in the entrance space. For example, the top plate 710 may be embedded in the ceiling of the entrance space and the footrest 720 may be embedded in the bottom of the entrance space. In this case, according to the entrance space, the top plate 710 and the footrest 720 may be designed differently.

Furthermore, the top plate 710 and the footrest 720 may be configured to constitute a single structure. For example, the top plate 710 and the footrest 720 may be configured as a single structure by a separate connecting structure. In this case, since the hygiene management device for an entrance hall can be configured as a mobile device (e.g., movable device that can be moved to various locations), the hygiene management device may be selectively installed not only in the vestibule of a house, but also in the entrance hall of a building or a place which requires the hygiene management of a person.

Hereinafter, the operation of the hygiene management device for an entrance hall according to the embodiment of the present disclosure described above will be described.

First, in an initial state in which a person does not enter, the first UV emission part 730 and the second UV emission part 740 may not operate.

That is, when a person is not detected by the detector 770, the first UV emission part 730 and the second UV emission part 740 may not operate.

When a person enters the entrance space and stands on the footrest 720, the detector 770 located on the top plate 710 may detect the person.

In addition, when the person is detected by the detector 770, power may be supplied to the first UV emission part 730 and the second UV emission part 740, and the first UV emission part 730 and the second UV emission part 740 may emit far-UV light.

That is, while the UV light source 731 of the first UV emission part 730 emits the far-UV light, the far-UV light may be emitted toward the footrest 720, and while the UV light source 741 of the second UV emission part 740 emits the far-UV light, the far-UV light may be emitted toward the top plate 710.

Here, some of the far-UV light emitted by the first UV emission part 730 may be supplied to a person's head and shoulders to kill the harmful bacteria of the associated portion. Additionally, the remaining far-UV light which is not directed to the person but emitted directly to the footrest 720 may be reflected to the periphery of the person's lower body by the second reflector 760 located on the footrest 720.

Furthermore, some of the far-UV light emitted by the second UV emission part 740 may be supplied to the person's legs to kill the harmful bacteria of the associated portion. Additionally, the remaining far-UV light which is not directed to the person but emitted directly to the top plate 710 may be reflected to the periphery of the person's upper body by the first reflector 750 located on the top plate 710. This is illustrated in FIG. 10.

In addition, after power is supplied to each of the first and second UV emission parts 730 and 740, after a predetermined period of time elapses or when the person leaves the footrest 720, the power supply to each of the first and second UV emission parts 730 and 740 may stop.

After all, in the hygiene management device for an entrance hall of the present disclosure, during the entering of a person, far-UV light may be emitted toward the person, so harmful bacteria on the person's clothes may be killed.

Furthermore, in the hygiene management device for an entrance hall of the present disclosure, the first and second UV emission parts 730 and 740 which emit far-UV light may be provided respectively on the upper and lower sides of the entrance space, respectively, so the person's upper and lower bodies may be sterilized.

Additionally, in the hygiene management device for an entrance hall of the present disclosure, the reflectors 750 and 760 may be provided on the top plate 710 and the footrest 720, respectively, so far-UV light may be emitted evenly to the front, back, and opposite sides of a person.

Meanwhile, the hygiene management device for an entrance hall of the present disclosure may be embodied in various forms mentioned in the embodiment described above.

For example, in the hygiene management device for an entrance hall of the present disclosure, the footrest 720 may be configured such that air is introduced thereinto. That is, dust or foreign matter falling from a person onto the footrest 720 may be immediately removed without being accumulated on the footrest 720.

Hereinafter, this will be described more in detail with reference to FIGS. 11 to 21.

Figure 11:
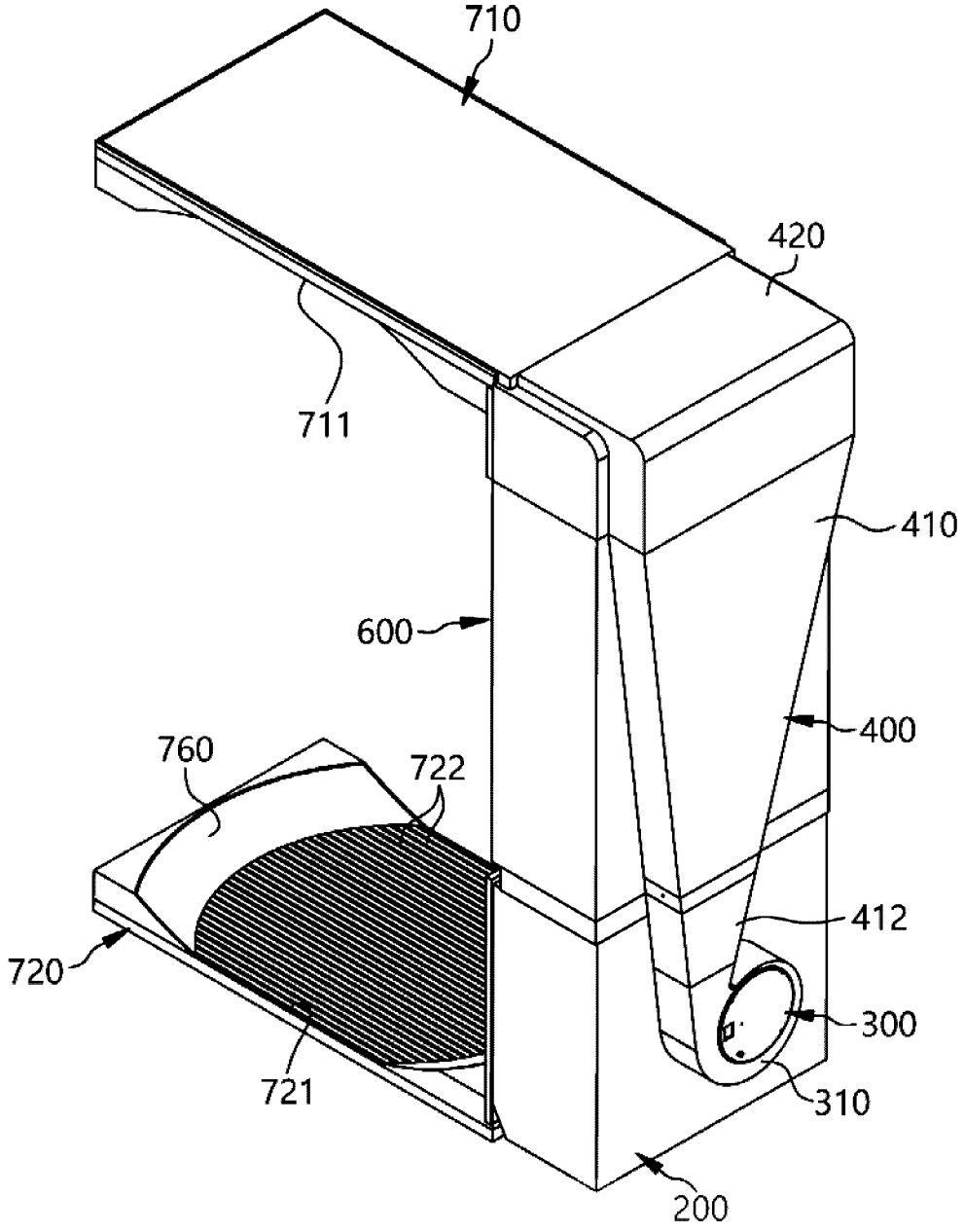
FIG. 11 is a rear perspective view of the hygiene management device for an entrance hall according to embodiment of the present invention.
Figure 12:
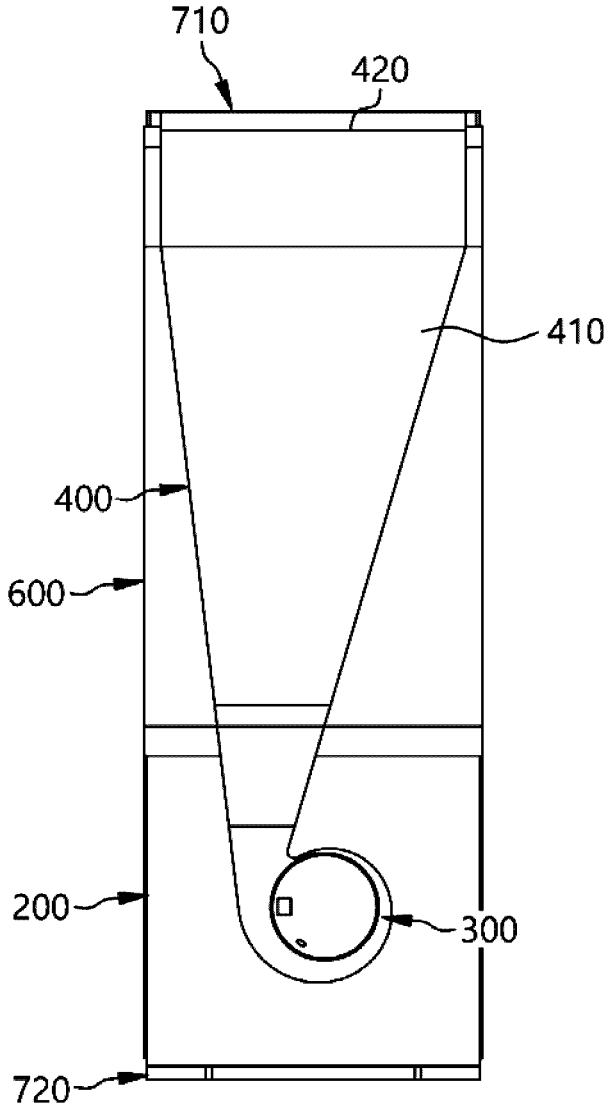
FIG. 12 is a rear view illustrating the hygiene management device for an entrance hall according to embodiment of the present invention.

Here, FIG. 11 is a rear perspective view of a state in which a fan assembly, an air management module, and a duct unit are connected to the top plate and the footrest, and FIG. 12 is a rear view of the state in which the fan assembly, the air management module, and the duct unit are connected to the top plate and the footrest.

Figure 13:
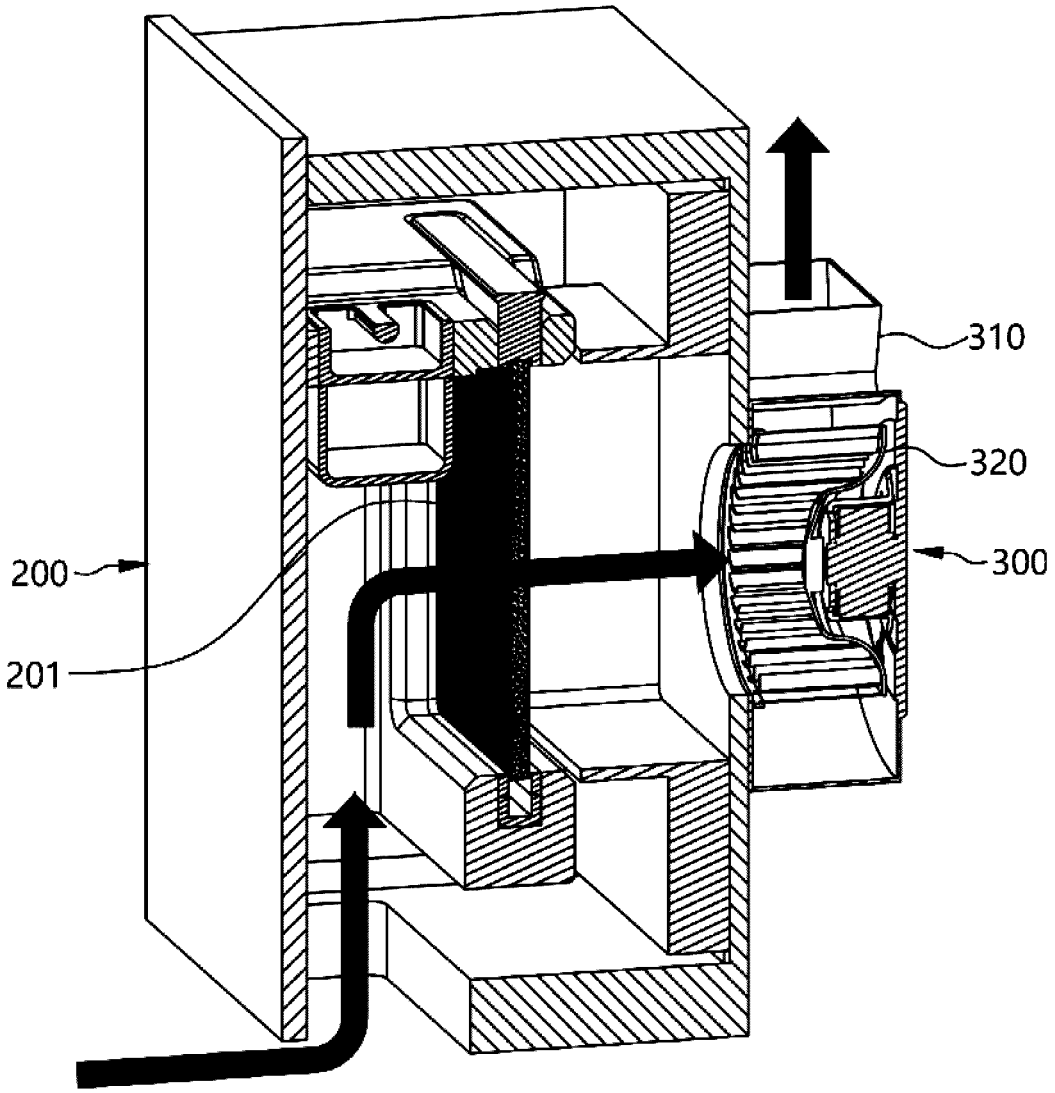
FIG. 13 is a perspective view illustrating a fan assembly of the hygiene management device for an entrance hall according to embodiment of the present invention.
Figure 14:
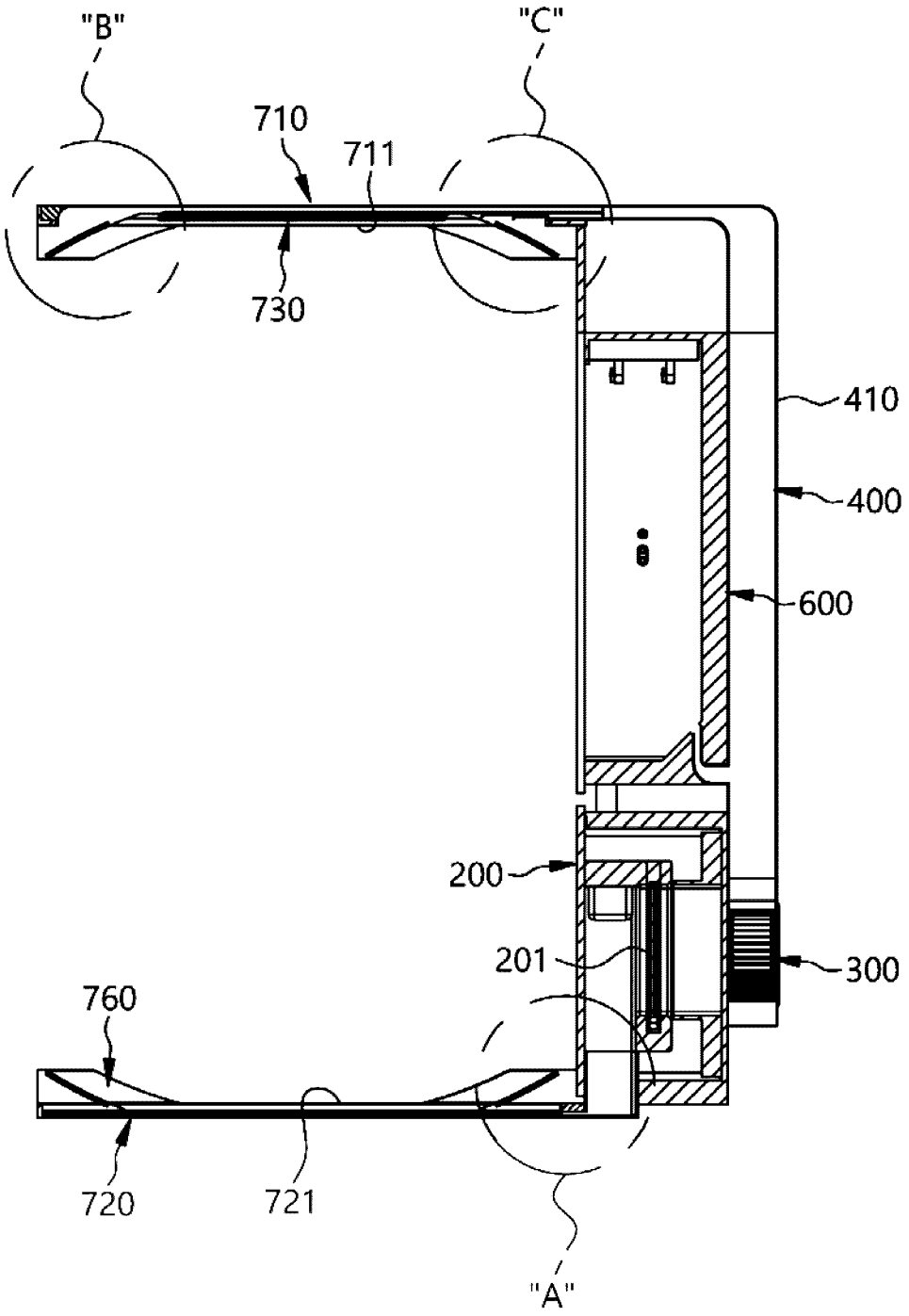
FIG. 14 is a sectional view of the hygiene management device for an entrance hall according to embodiment of the present invention.

In addition, FIG. 13 is a perspective view of the fan assembly, and FIG. 14 is a sectional view of the state in which the fan assembly, the air management module, and the duct unit are connected to the top plate and the footrest.

As illustrated in these drawings, the hygiene management device for an entrance hall according to another embodiment of the present disclosure may be provided with the fan assembly 300 which generates an air blowing force to blow air.

The fan assembly 300 may be configured to be connected to the footrest 720 so as to introduce air thereto from the footrest 720.

The fan assembly 300 may include a fan housing 310 and a blower fan 320.

The fan housing 310 may constitute the exterior of the fan assembly 300, and the blower fan 320 may be installed (e.g., positioned in) in the fan housing 310.

Furthermore, an air management module 200 may be provided between the footrest 720 and the fan assembly 300. The air management module 200 may function to connect the footrest 720 with the fan assembly 300 such that air introduced into the footrest 720 flows through the air management module 200 to the fan assembly 300. That is, the air management module 200 may filter air received from the footrest 720 before entering the fan assembly 300 (e.g., via filter 201).

Particularly, the air management module 200 may be provided with at least one filter 201. That is, the air management module 200 may be provided in a portion through which air flows from the footrest 720 to the fan assembly 300 such that foreign matter contained in the air is removed.

Figure 15:
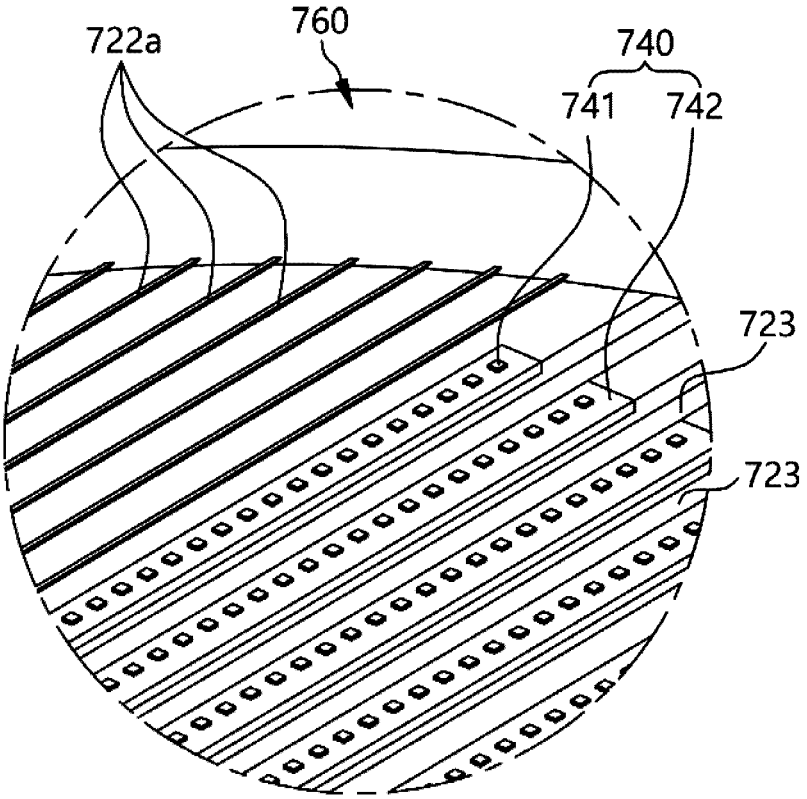
FIG. 15 is a perspective view illustrating the detailed structure of the footrest of the hygiene management device for an entrance hall according to embodiment of the present invention.
Figure 16:
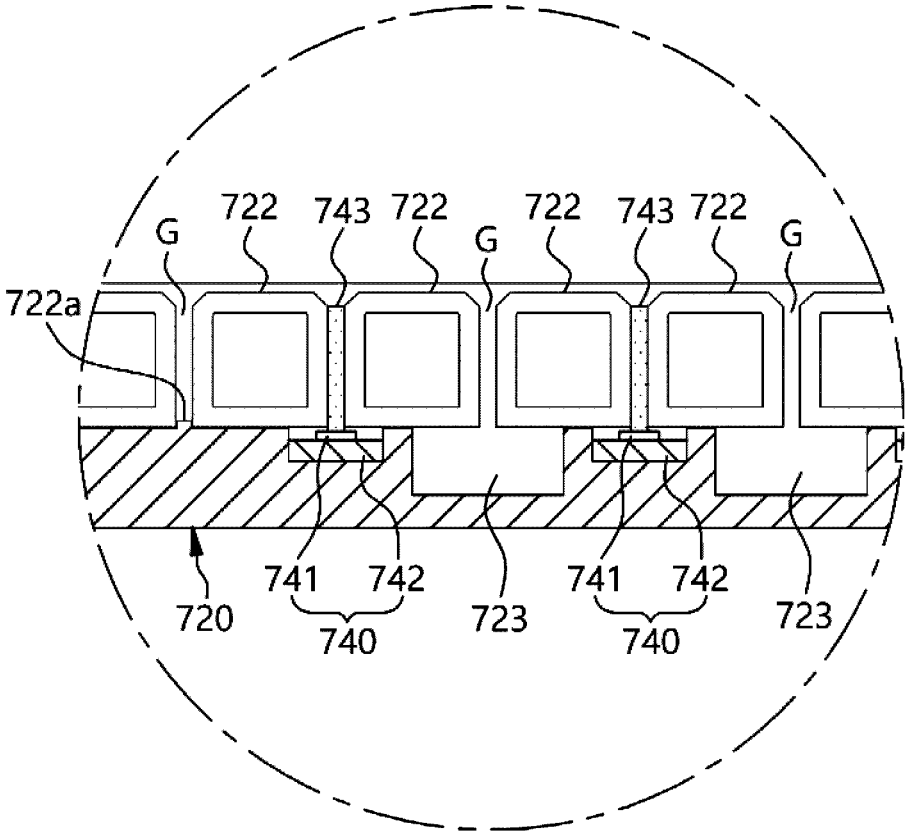
FIG. 16 is a sectional view illustrating the internal structure of the footrest of the hygiene management device for an entrance hall according to embodiment of the present invention.
Figure 17:
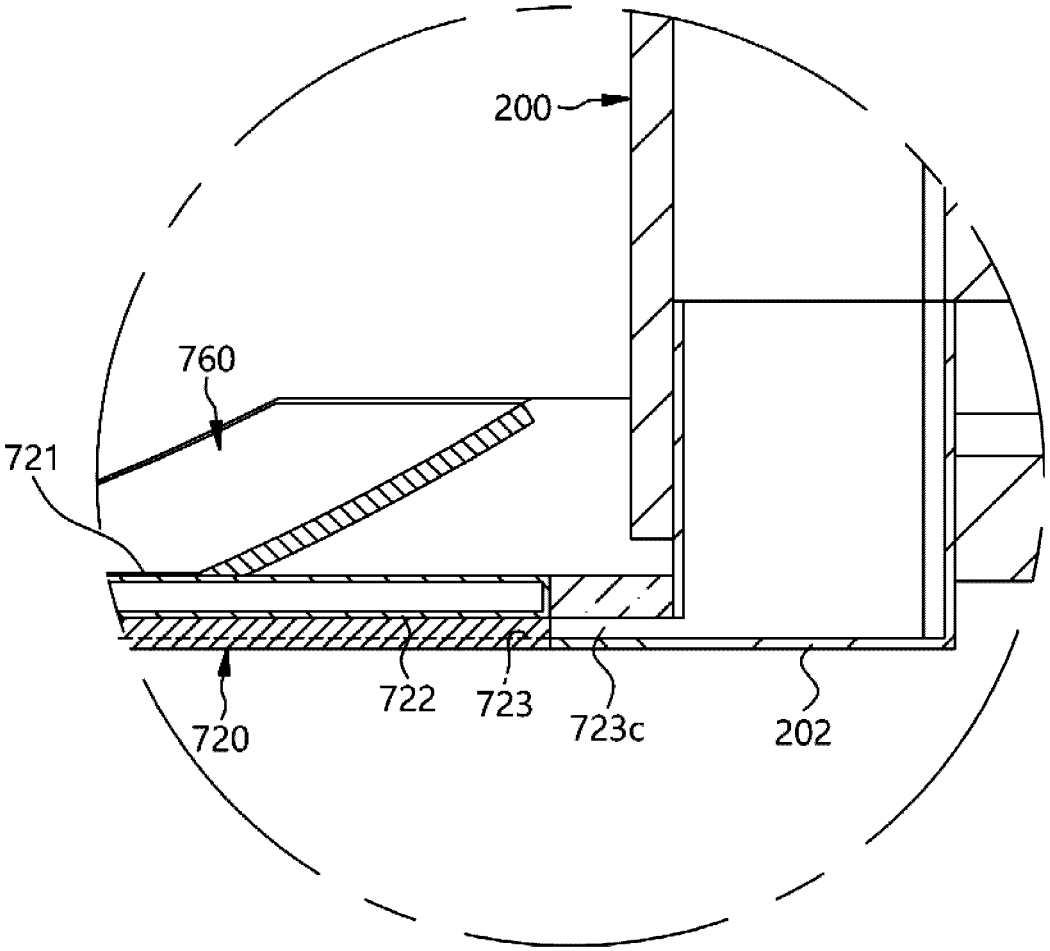
FIG. 17 is an enlarged view of an "A" part of FIG. 14.

As illustrated in FIGS. 15 and 16, a plurality of introduction flow paths 723 which guides an air flow may be formed in the footrest 720. Specifically, each of the introduction flow paths 723 may be formed between each of the lower support bars 722 in the upper surface of the footrest 720. That is, air or foreign matter introduced through a gap G (see FIG. 16) between each of the lower support bars 722 may flow along each of the introduction flow paths 723 and may be supplied to the fan assembly 300.

Of course, the second UV emission part 740 may be located in each of some portions of portions between the lower support bars 722, and the introduction flow path 723 may be located in each of other portions between the lower support bars 722. Preferably, the second UV emission part 740 and the introduction flow path 723 may be alternately located at positions between the lower support bars 722.

A communication flow path 723*c* may be formed at the air outlet side of each of the introduction flow paths 723 to communicate with each other, and an introduction duct 202, which constitutes the air inlet side of the air management module 200, may be connected to the communication flow path 723*c*. That is, air and foreign matter flowing through each of the introduction flow paths 723 may be introduced into the air management module 200 through the introduction duct 202 of the air management module 200 via the communication flow path 723*c*, may pass through the filter 201, and then may be supplied to the fan assembly 300.

In addition, a duct unit 400 may be connected to the air outlet side of the fan assembly 300.

The duct unit 400 may guide the discharge flow of air. Specifically, the duct unit 400 may guide the flow of air such that the air is discharged toward the person.

That is, a circulation in which air introduced into the fan assembly 300 bypassing through the footrest 720 from the entrance space is discharged through the duct unit 400 to a person in the entrance space may be repeated. Accordingly, foreign matter contained in air in the entrance space may be filtered by the air management module 200 to purify the entrance space.

Particularly, the duct unit 400 may guide the air such that the air is discharged through the top plate 710 to the person. That is, air may be discharged from a side opposite to the introduction side of the air. Accordingly, sufficient air may be discharged from the head of the person located on the footrest 720 toward the person.

Such a duct unit 400 may include a first duct 410 and a second duct 420.

Here, the first duct 410 may extend along the side wall of the entrance space, and a first inlet 412 of the first duct 410 may be connected to the air outlet side of the fan assembly 300.

In addition, the second duct 420 may be located at the ceiling of the entrance space and may be configured to receive air flowing through the first duct 410.

The first end of the second duct 420 may be connected to the first duct 410, and the second end of the second duct 420 may be connected to the perimeter surface of the rear side of the top plate 710.

Figure 19:
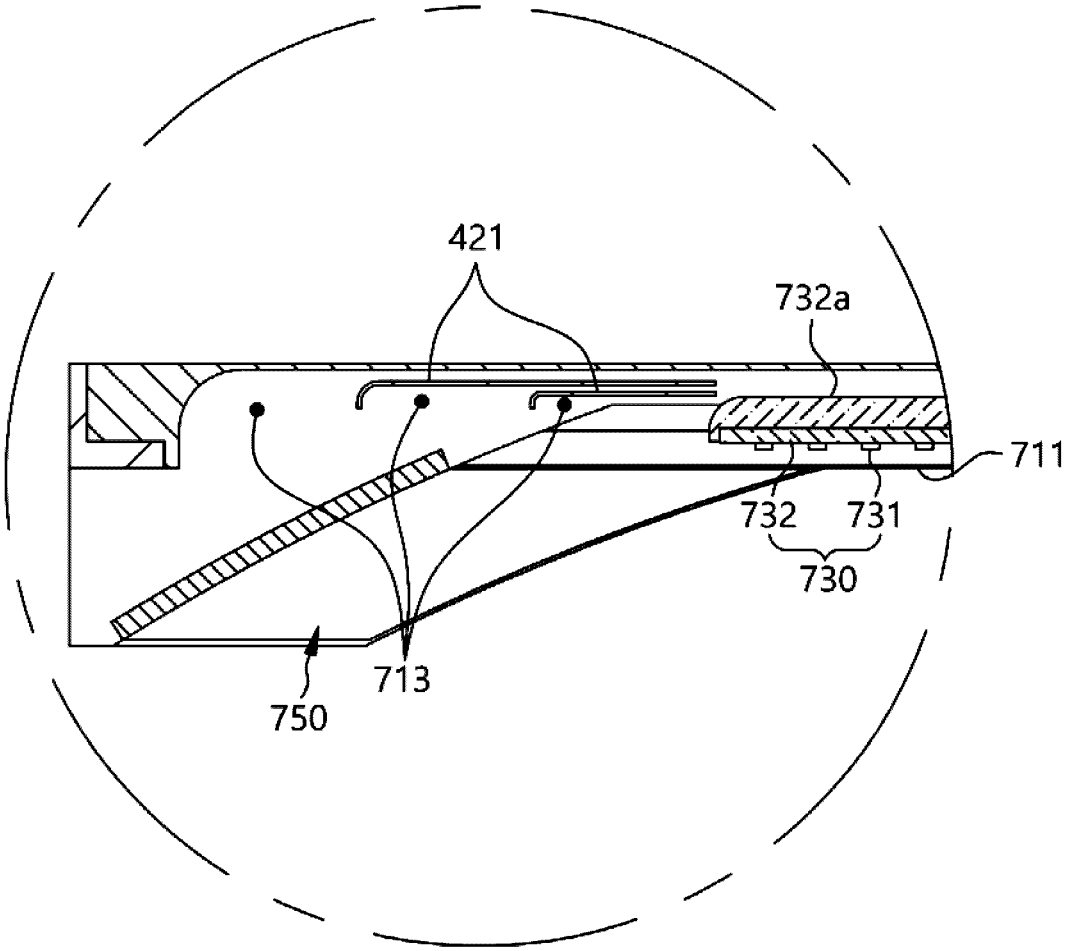
FIG. 19 is an enlarged view of a "B" part of FIG. 14.
Figure 20:
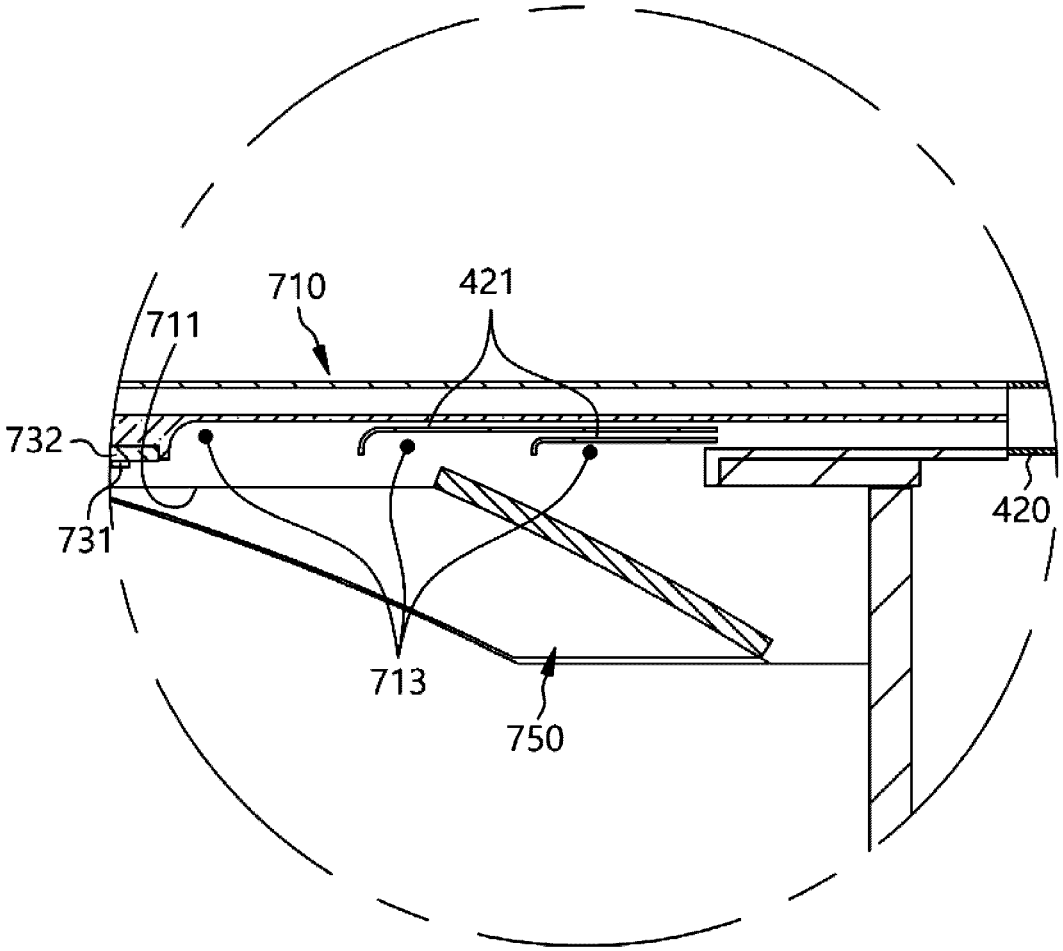
FIG. 20 is an enlarged view of a "C" part of FIG. 14.

In addition, as illustrated in FIGS. 19 and 20, a discharge hole 713 (or multiple discharge holes), which discharges air toward a person, may be formed in the top plate 710. A discharge rib 421 (or multiple discharge ribs 421), which guides the discharge direction of air, may be provided in the discharge hole 713. The discharge rib 421 may be configured such that the discharge angle of air is adjusted as required.

Figure 18:
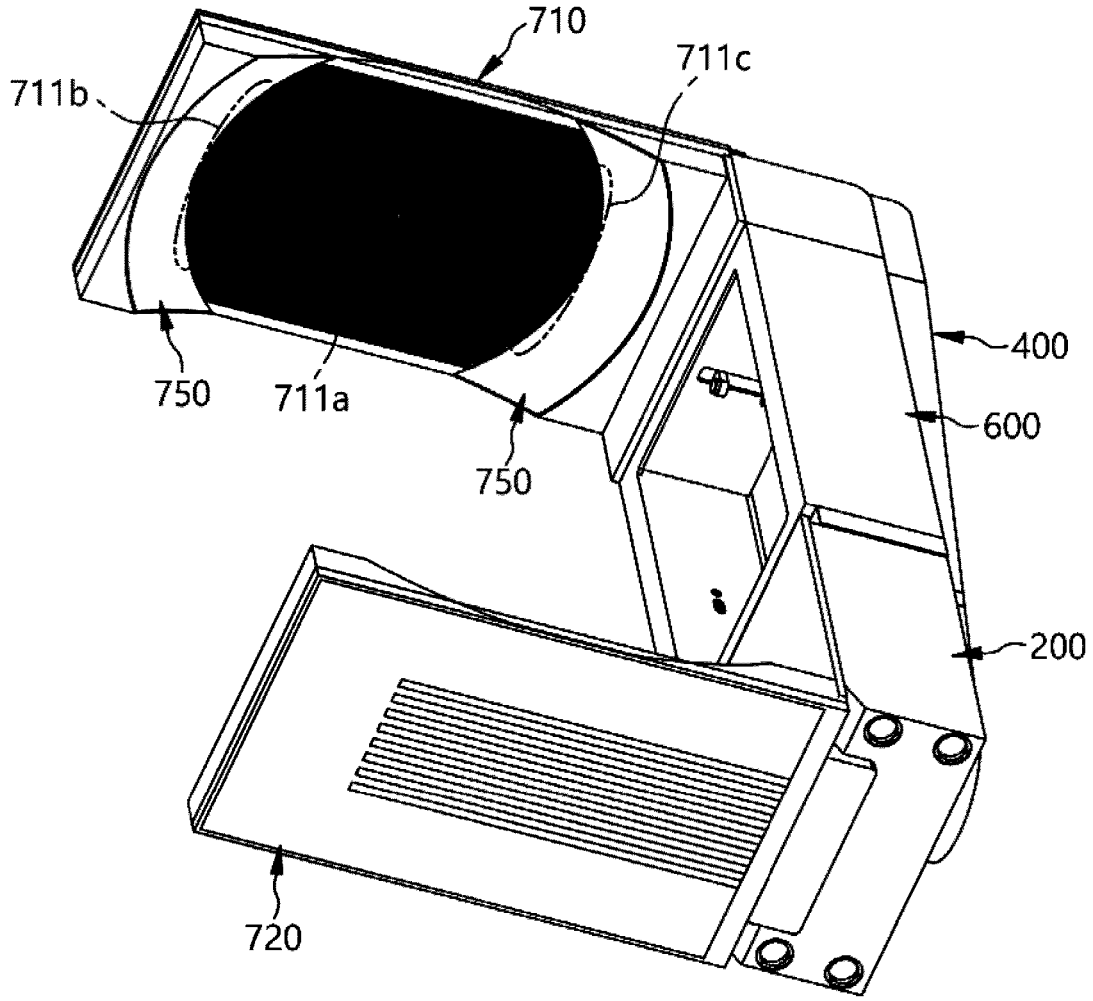
FIG. 18 is a perspective view illustrating the lower side structure of the top plate of the hygiene management device for an entrance hall according to an embodiment of the present invention.

The discharge hole 713 may be formed in at least one portion of sides of the perimeter of the first UV emission part 730. For example, the first UV emission part 730 may be located at the center portion of the top plate 710, and the discharge hole 713 may be formed in each of a first discharge area 711*b* of a first side of the first UV emission part 730 and a second discharge area 711*c* of a second side thereof, as illustrated in FIG. 18. In this case, the first discharge area 711*b* may be located at a position far from a first duct unit 410 relative to the first UV emission part 730, and the second discharge area 711*c* may be located at a position close from the first duct unit 410 relative to the first UV emission part 730. That is, the first discharge area 711*b* may be located spaced further away from the first duct unit 410 than the second discharge area 711*c*.

Figure 21:
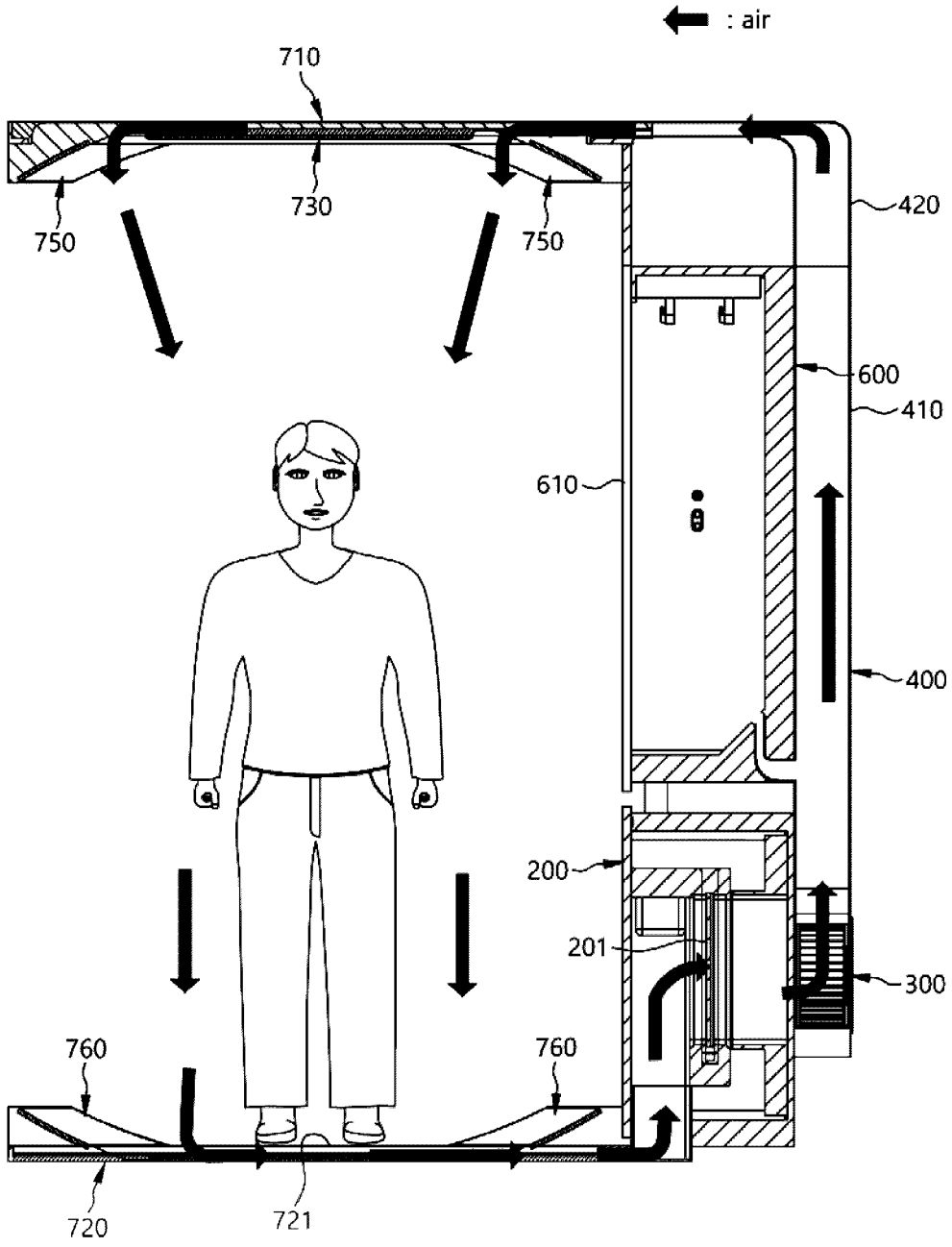
FIG. 21 is a side view of a state in which air is discharged to a person by the hygiene management device for an entrance hall according to an embodiment of the present invention.

FIG. 21 is a side view of a state in which air is discharged toward a person.

That is, due to the structure according to the another embodiment of the present disclosure described above, air in the entrance space may be introduced into the footrest 720 and then may flow sequentially through the air management module 200 and the fan assembly 300. Continuously, after the air may flow through the duct unit 400, the air may be discharged through the top plate 710 (e.g., via the at least one discharge hole 713) toward the person, and then may be introduced back into the footrest 720. This air circulation may be repeated.

Accordingly, in the hygiene management device for an entrance hall according to the another embodiment of the present disclosure, a structure which discharges air to a person may be provided, the sterilization of the person and the removal of foreign matter may be simultaneously performed.

In addition, in the hygiene management device for an entrance hall according to the another embodiment of the present disclosure, the footrest 720 may be configured such that air is introduced thereinto, so various foreign matter present on the footrest 720 may be automatically removed.

Furthermore, in the hygiene management device for an entrance hall according to the another embodiment of the present disclosure, air of the entrance space may be repeatedly circulated through the air management module 200, so the air of the entrance space may be constantly maintained to be clean.

Meanwhile, a function module 600 may be installed on the upper portion of the air management module 200.

As an example of the function module 600, there may be a clothing management device. When clothes are placed in the clothing management device, the clothing management device may remove dust on the clothes or sterilize the clothes. Alternatively, the clothing management device may function to unwrinkle the clothes. The function module 600 may be in the form of an enclosure and may receive air from the duct unit 400 (e.g., to sterilize an object placed in the function module 600). That is, the function module 600 may be fluidly connected to the duct unit 400.

As other examples of the function module 600, there may be various devices such as a shoe management device, an umbrella management device, a shoe storage device, and an umbrella storage device, and the function module 600 may be provided as space for storing a user's belongings. For reference, each of these function modules 600 may not be configured as an independent function module, but some of the function modules may be combined with each other.

In addition, the internal space of the function module 600 may be configured to be open to the entrance space, and the open portion may be configured to be opened and closed by a door 610. In this case, the door 610 may be configured as a swinging door.

Accordingly, the hygiene management device for an entrance hall of the present disclosure may be embodied in various forms.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A hygiene management device, comprising:

a top plate defining an upper side of the hygiene management device, the top plate including a first Ultra-Violet (UV) emission part configured to emit far-UV light downward toward an upper body of a person; and a footrest defining a bottom of the hygiene management device, facing the top plate, the footrest including a second UV emission part configured to emit far-UV light upward toward a lower body of the person, wherein the top plate includes a first concave part, the first concave part having a circumferential surface that is enlarged downward in a center portion of a lower surface of the top plate, wherein the first UV emission part is located in a first emission area of the first concave part, wherein the footrest includes a second concave part, the second concave part having a circumferential surface that is enlarged upward in a center portion of an upper surface of the footrest, wherein the second UV emission part is located in a second emission area of the second concave part, wherein a first reflector configured to reflect the far-UV light emitted from the second UV emission part toward the upper body of the person is provided along a circumference of the first concave part, and wherein a second reflector configured to reflect the far-UV light emitted from the first UV emission part toward the lower body of the person is provided along a circumference of the second concave part.

2. The hygiene management device of claim 1, wherein the first UV emission part is provided on the lower surface of the top plate.

3. The hygiene management device of claim 2, wherein the lower surface of the top plate includes the first reflector surrounding the first UV emission part, the first reflector being inclined relative to the first UV emission part.

4. The hygiene management device of claim 3, wherein the first UV emission part includes:

a mounting plate;

a substrate mounted to the mounting plate; and a UV light source disposed on the substrate configured to emit far-UV light.

5. The hygiene management device of claim 3, wherein the footrest includes the second reflector disposed on the upper surface of the footrest, the second reflector being inclined relative to the second UV emission part.

6. A hygiene management device, comprising:

a top plate defining an upper side of the hygiene management device, the top plate including a first Ultra-Violet (UV) emission part configured to emit far-UV light downward toward an upper body of a person; and a footrest defining a bottom of the hygiene management device, facing the top plate, the footrest including a second UV emission part configured to emit far-UV light upward toward a lower body of the person, wherein the footrest further includes a plurality of support bars provided on an upper surface of the footrest, the plurality of support bars being spaced apart from each other, wherein the second UV emission part is located within at least one gap between adjacent support bars among the plurality of support bars, and wherein the second UV emission part includes:

a substrate:

a UV light source disposed on the substrate; and a light guide plate disposed on the UV light source and between adjacent support bars among the plurality of support bars.

7. The hygiene management device of claim 6, further comprising an air management module including:

an introduction duct; and a filter configured to filter air, wherein the footrest further includes a plurality of air introduction flow paths formed between each of the support bars and configured to introduce air through the footrest into the introduction duct of the air management module.

8. The hygiene management device of claim 1, further comprising a detector configured to detect the person within the hygiene management device, the detector being provided in at least one of the top plate and the footrest, wherein each of the first UV emission part and the second UV emission part is configured to:

operate in response to the person being detected by the detector, and turn off in response to a person not being detected by the detector.

9. The hygiene management device of claim 8, wherein the top plate includes a discharge hole and is configured to discharge air through the discharge hole towards the person.

10. The hygiene management device of claim 1, further comprising:

an air management module including:

an introduction duct; and a filter configured to filter air that is received from the footrest;

a fan assembly connected to the footrest, the fan assembly being configured to receive air from the footrest and generate air flow; and a duct unit configured to guide air to the top plate.

11. The hygiene management device of claim 10, wherein the top plate further includes a discharge hole that is formed in at least one portion of sides of a perimeter of the first UV emission part.

12. A hygiene management device, comprising:

a top plate positioned an upper side of the hygiene management device, the top plate including:

a first concave part at a lower surface of the top plate and having a concave shape;

a first Ultra-Violet (UV) emission part provided in the first concave part and configured to emit far-UV light downward toward an upper body of a person; and a first reflector configured to reflect the far-UV light; and a footrest located on a bottom of the hygiene management device, facing the top plate, the footrest including:

a second concave part provided on an upper surface of the footrest and having a concave shape;

a second UV emission part provided in the second concave part and configured to emit far-UV light upward toward a lower body of the person; and a second reflector configured to reflect the far UV light, wherein the footrest further includes a plurality of support bars provided on the upper surface of the footrest, the plurality of support bars being spaced apart from each other, and wherein the second UV emission part includes:

a substrate;

a UV light source disposed on the substrate; and a light guide plate disposed on the UV light source and between adjacent support bars among the plurality of support bars.

13. The hygiene management device of claim 12, wherein the first reflector is positioned along a circumference of the first concave part, and wherein the second reflector is positioned along a circumference of the second concave part.

14. The hygiene management device of claim 12, further comprising:

an air management module including:

an introduction duct; and a filter configured to filter air that is received from the footrest;

a fan assembly connected to the footrest, the fan assembly being configured to receive air from the footrest and generate air flow; and a duct unit configured to guide air to the top plate.

15. The hygiene management device of claim 14, wherein the top plate further includes:

a discharge hole that is configured to discharge air towards the person; and at least one discharge rib disposed between the first UV emission part and a rear surface of the top plate, the at least one discharge rib being configured to guide air from the duct unit to the discharge hole.

16. The hygiene management device of claim 12, further comprising an air management module including:

an introduction duct; and a filter configured to filter air, wherein the footrest further includes a plurality of air introduction flow paths formed between each of the support bars and configured to introduce air through the footrest into the introduction duct of the air management module.

17. The hygiene management device of claim 1, wherein the first reflector and the second reflector each include a curved inclined surface.

18. The hygiene management device of claim 17, wherein the first reflector and the second reflector each further include a flat portion protruding from an edge of the curved inclined surface.

19. The hygiene management device of claim 17, wherein the first reflector is configured to only partially surround the first UV emission part, and wherein the second reflector is configured to only partially surround the second UV emission part.

20. The hygiene management device of claim 8, wherein the detector is located in a central portion of the first UV emission part.

* * * * *